US011383540B2

(12) United States Patent
Hyuga et al.

(10) Patent No.: US 11,383,540 B2
(45) Date of Patent: Jul. 12, 2022

(54) PRINTING APPARATUS

(71) Applicant: Panasonic Intellectual Property Management Co., Ltd., Osaka (JP)

(72) Inventors: Ryoji Hyuga, Osaka (JP); Takayuki Abe, Osaka (JP); Hidehiro Yoshida, Osaka (JP); Tohru Nakagawa, Osaka (JP); Makoto Okazaki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 15 days.

(21) Appl. No.: 16/952,141

(22) Filed: Nov. 19, 2020

(65) Prior Publication Data

US 2021/0170769 A1 Jun. 10, 2021

(30) Foreign Application Priority Data

Dec. 4, 2019 (JP) ..... JP2019-219462

(51) Int. Cl.

| | |
|---|---|
| ***B41J 3/407*** | (2006.01) |
| ***B41J 29/38*** | (2006.01) |
| ***B41J 2/045*** | (2006.01) |
| ***B41J 25/00*** | (2006.01) |

(52) U.S. Cl.

CPC ..... *B41J 29/38* (2013.01); *B41J 2/04505* (2013.01); *B41J 2/04586* (2013.01); *B41J 3/4073* (2013.01); *B41J 25/003* (2013.01)

(58) Field of Classification Search

CPC ... B41J 3/407; B41J 3/40733; B41J 11/00218

See application file for complete search history.

(56) References Cited

U.S. PATENT DOCUMENTS

| | | | | |
|---|---|---|---|---|
| 10,710,378 | B1 * | 7/2020 | Bullington | B41J 3/4073 |
| 2016/0096365 | A1 | 4/2016 | Koga | |
| 2016/0185130 | A1 * | 6/2016 | Sugai | B41J 11/0015 347/102 |
| 2019/0134993 | A1 * | 5/2019 | Leo | H04N 1/0019 |
| 2019/0210363 | A1 * | 7/2019 | Ohara | B41J 2/04573 |

FOREIGN PATENT DOCUMENTS

| | | | |
|---|---|---|---|
| EP | 2839964 A1 * | 2/2015 | B25J 11/0075 |
| JP | 2004-351676 | 12/2004 | |
| JP | 2014-223732 | 12/2014 | |
| JP | 2016-179591 | 10/2016 | |
| JP | 6426038 B | 11/2018 | |

* cited by examiner

*Primary Examiner* — Scott A Richmond

(74) *Attorney, Agent, or Firm* — Wenderoth, Lind & Ponack, L.L.P.

(57) ABSTRACT

A printing unit includes a plurality of ink jet parts and an X-axis linear motion mechanism that moves each of the plurality of ink jet parts in the same main scanning direction. The X-axis linear motion mechanism moves the ink jet part involved in printing the workpiece among the plurality of ink jet parts so as to face the surface of the workpiece and moves the remaining ink jet part on the one X-axis linear motion mechanism so as to retreat from the surface of the workpiece. As a result, a printing apparatus that is capable of printing accurately onto the workpiece having a three-dimensional curved surface is provided.

16 Claims, 19 Drawing Sheets

PRINTING APPARATUS

BACKGROUND

1. Technical Field

The present disclosure relates to a printing apparatus.

2. Description of the Related Art

In the related art, a printing apparatus for printing on a workpiece having a curved surface by using an ink jet is known, for example, in Japanese Patent No. 6426038 (hereinafter referred to as "Patent Literature 1").

Patent Literature 1 discloses a printing apparatus having a configuration in which an ink droplet is discharged by tilting a nozzle row in a sub scanning direction with respect to a side surface of a workpiece having a cylindrical shape body whose axial direction is a main scanning direction of an ink jet head.

However, the printing apparatus of Patent Literature 1 is limited to those in which the cross-sectional shape of the workpiece that can be printed is a cylindrical shape body. Therefore, there is a demand for a printing apparatus capable of printing with high accuracy even on a workpiece having any three-dimensional curved surface, not limited to a workpiece having a cylindrical shape body.

SUMMARY

The present disclosure provides a printing apparatus capable of printing a predetermined image with high accuracy by discharging droplets onto a workpiece having a three-dimensional curved surface according to the configuration indicated below.

That is, the printing apparatus of the present disclosure includes a printing unit that discharges ink onto a surface of the workpiece and a workpiece drive unit that adjusts a position of the workpiece. The printing unit includes a plurality of ink jet parts that discharge the ink and a main scanning linear motion mechanism that moves each of the plurality of ink jet parts in a same main scanning direction.

According to this configuration, the main scanning linear motion mechanism moves each of the plurality of ink jet parts in the same main scanning direction. That is, the main scanning linear motion mechanism moves each of the plurality of ink jet parts independently along the main scanning direction. As a result, for example, a printing apparatus capable of printing with a high degree of freedom can be obtained even on a workpiece having a recessed surface or a projection surface.

Further, the main scanning linear motion mechanism of the printing apparatus of the present disclosure moves the ink jet part involved in printing the workpiece among the plurality of ink jet parts so as to face the surface of the workpiece and moves one or more remaining ink jet parts among the plurality of ink jet parts to retreat from the surface of the workpiece.

According to this configuration, printing is performed with only the ink jet part involved in the printing facing the surface of the workpiece. On the other hand, the ink jet part that is not involved in the printing is configured to retreat from the workpiece so as not to interfere with the workpiece. As a result, the degree of freedom in a position adjustment motion of the workpiece can be increased.

Further, the printing unit of the printing apparatus of the present disclosure includes a sub scanning linear motion mechanism that moves at least one of the plurality of ink jet parts in a sub scanning direction intersecting with the main scanning direction.

According to this configuration, at least one of the plurality of ink jet parts is configured to be movable in the sub scanning direction. That is, only the ink jet part of the color that is a printing target is printed close to the workpiece. Therefore, interference between the workpiece and the ink jet part of other colors that are not the printing target can be prevented. As a result, the degree of freedom in a position adjustment motion of the workpiece can be increased.

Further, the printing unit of the printing apparatus of the present disclosure includes a forward and backward linear motion mechanism that moves at least one of the plurality of ink jet parts forward and backward with respect to the workpiece.

According to this configuration, the forward and backward linear motion mechanism moves at least one of the plurality of ink jet parts forward and backward with respect to the workpiece. That is, the forward and backward linear motion mechanism prints only the ink jet part of the color that is a printing target close to the workpiece. Therefore, interference between the workpiece and the ink jet part of other colors that are not the printing target can be prevented. As a result, the degree of freedom in a position adjustment motion of the workpiece can be increased.

Further, the printing unit of the printing apparatus of the present disclosure includes a rotation mechanism that rotates at least one of the plurality of ink jet parts.

According to this configuration, the ink jet part is configured to be rotatably by a rotation mechanism. As a result, a nozzle position of the ink jet part with respect to the workpiece can be finely adjusted by the rotation mechanism while moving the ink jet part in the main scanning direction.

Specifically, the rotation mechanism, for example, forms the plurality of nozzle rows arranged in a row along the sub scanning direction of the ink jet part in a position inclined obliquely with respect to the main scanning direction. Thereby, the pitch between the plurality of nozzles arranged in a row can be reduced. As a result, the print resolution of the printing apparatus can be increased.

Further, the rotation mechanism rotates, for example, the nozzle row of the ink jet part by 90° with respect to the main scanning direction. Thereby, the printing direction with respect to the workpiece can be changed. As a result, the accuracy of ink landing onto the workpiece can be improved.

Further, the workpiece drive unit of the printing apparatus of the present disclosure includes drive mechanisms of at least four axes, and at least two axes of the drive mechanisms of four axes are configured by a rotation mechanism.

According to this configuration, the workpiece drive unit includes the drive mechanisms of at least four axes, and at least two axes thereof are configured by a rotation mechanism. As a result, the adjustment range of the position of the workpiece can be widened. Therefore, the position adjustment according to the curved surface of the workpiece can be speeded up, and the workpiece can be printed with high accuracy.

Further, the main scanning linear motion mechanism of the printing apparatus of the present disclosure includes a first main scanning linear motion mechanism and a second main scanning linear motion mechanism arranged in parallel to each other. The plurality of ink jet parts are arranged in a row along the main scanning direction, and are alternately attached to the first main scanning linear motion mechanism and the second main scanning linear motion mechanism.

According to this configuration, the first main scanning linear motion mechanism and the second main scanning linear motion mechanism are arranged in parallel to each other. The plurality of ink jet parts are arranged in a row along the main scanning direction, and are alternately attached to the first main scanning linear motion mechanism and the second main scanning linear motion mechanism. Thereby, a gap between the ink jet part attached to the first main scanning linear motion mechanism and the ink jet part attached to the second main scanning linear motion mechanism can be set small. As a result, the entire length of the printing apparatus in the main scanning direction can be reduced.

According to the present disclosure, it is possible to provide a printing apparatus capable of printing accurately on a workpiece having a three-dimensional curved surface.

DETAILED DESCRIPTION

Hereinafter, exemplary embodiments of the present disclosure will be described based on the drawings. The following description of the desired exemplary embodiments is essentially merely an example and is not intended to limit the present disclosure, application of the disclosure, or use of the disclosure.

Exemplary Embodiment 1

Hereinafter, a schematic configuration of printing apparatus 1 of Exemplary Embodiment 1 of the present disclosure will be described based on FIGS. 1 to 3.

Figure 1:
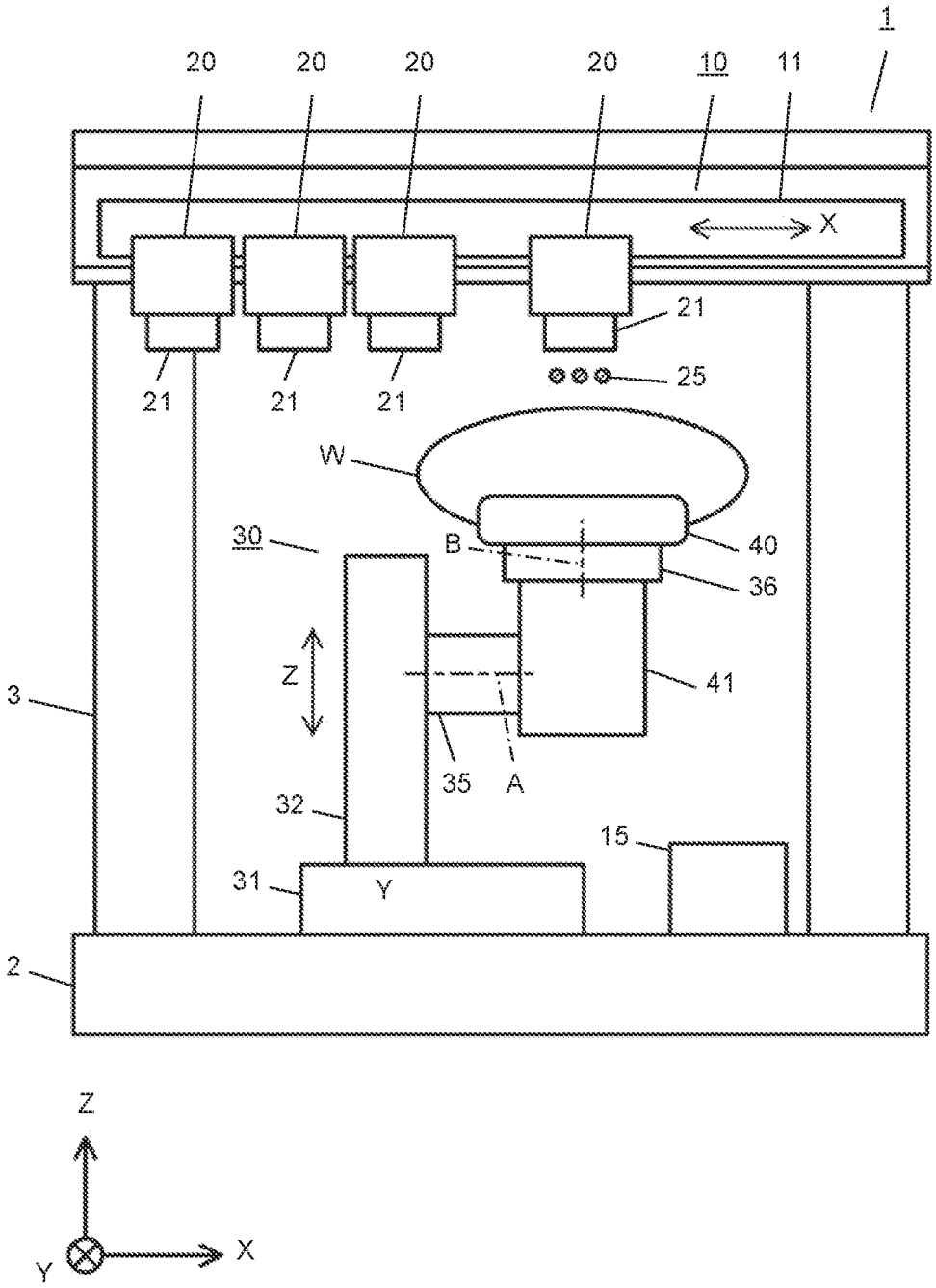
FIG. 1 is a front view illustrating a schematic configuration of a state in which a workpiece of a printing apparatus according to Exemplary Embodiment 1 is turned upward.

FIG. 1 is a front view illustrating a schematic configuration of printing apparatus 1 according to Exemplary Embodiment 1. FIG. 2 is a side view illustrating a schematic configuration of printing apparatus 1. FIG. 3 is a side view illustrating a schematic configuration when a position of workpiece W of printing apparatus 1 is changed.

Figure 2:
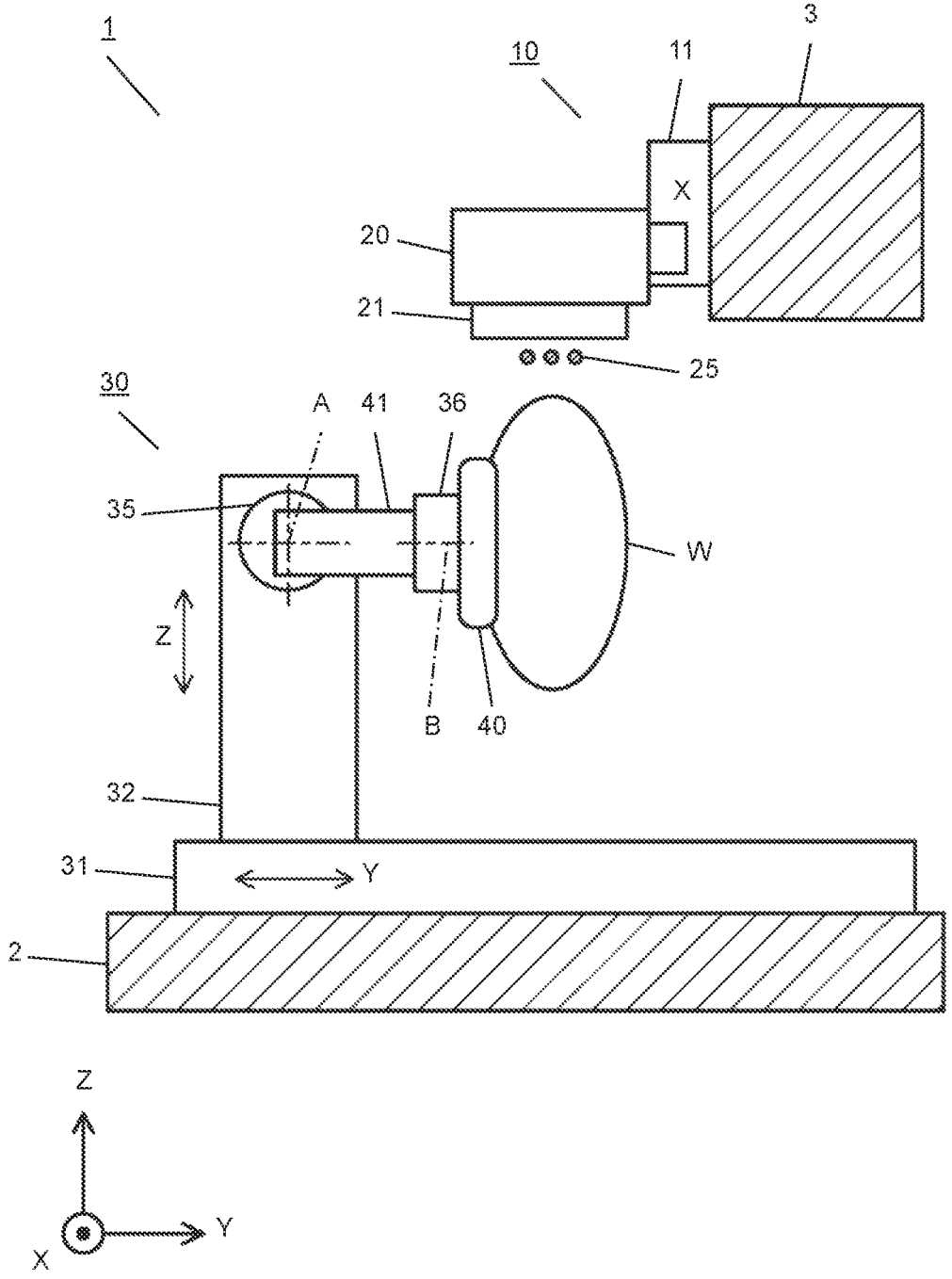
FIG. 2 is a side view illustrating a schematic configuration of a state in which the workpiece of the same printing apparatus is moved downward.
Figure 3:
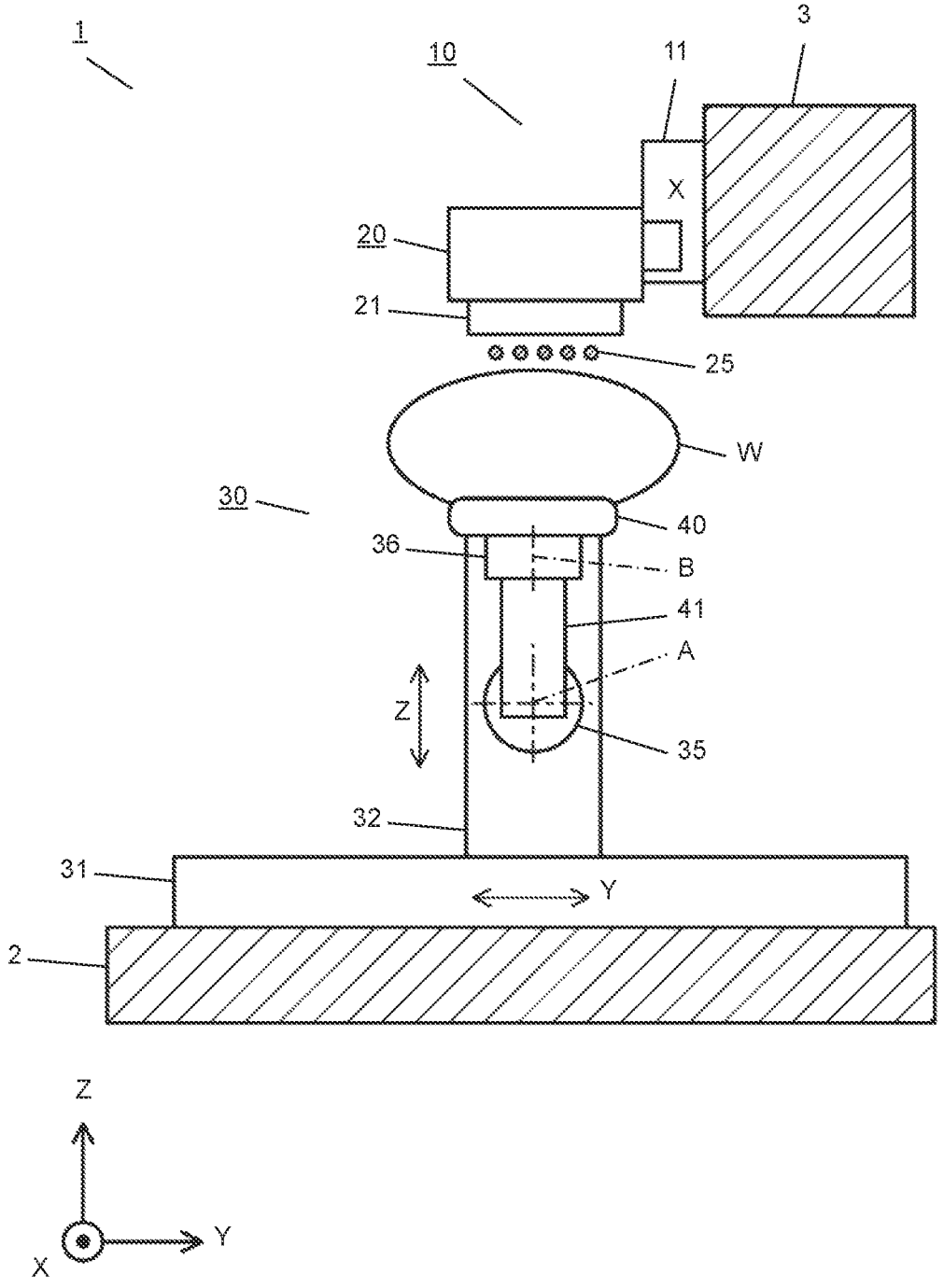
FIG. 3 is a side view illustrating a schematic configuration when a position of the workpiece of the same printing apparatus is changed.

As illustrated in FIGS. 1 to 3, printing apparatus 1 of Exemplary Embodiment 1 is an apparatus that prints a predetermined image by discharging droplet 25 such as ink or a coating material onto workpiece W having a three-dimensional curved surface. Workpiece W is formed of, for example, a resin molded product or the like.

Printing apparatus 1 includes printing unit 10, workpiece drive unit 30, controller 15, and the like. Printing apparatus 1 further includes frame 2 and gate-shaped gantry 3 erected from frame 2. Workpiece drive unit 30 is disposed on frame 2. Printing unit 10 is disposed on gantry 3.

Printing apparatus 1 of Exemplary Embodiment 1 is configured as described above.

Hereinafter, printing apparatus 1 of Exemplary Embodiment 1 will be described by dividing printing apparatus 1 into terms for each component.

Printing Unit

First, a configuration of printing unit 10 of printing apparatus 1 will be described.

As illustrated in FIG. 1, printing unit 10 is disposed more upward than a printing surface of workpiece W. Printing unit 10 includes X-axis linear motion mechanism 11 (sometimes referred to as a "main scanning linear motion mechanism") which is a drive mechanism of one axis, a plurality of ink jet parts 20, and the like.

The X-axis linear motion mechanism 11 is attached to gantry 3. Each of the plurality of ink jet parts 20 is attached to X-axis linear motion mechanism 11. X-axis linear motion mechanism 11 moves each of the plurality of ink jet parts 20 in the same main scanning direction (in FIG. 1, the horizontal direction (X direction)).

Specifically, X-axis linear motion mechanism 11 is configured by a linear motor type drive mechanism. X-axis linear motion mechanism 11 drives each of the plurality of ink jet parts 20 individually in the X direction. As a result, X-axis linear motion mechanism 11 drives only ink jet part 20 that is involved in printing among the plurality of ink jet parts 20 so as to face a surface of workpiece W. At the same time, X-axis linear motion mechanism 11 drives ink jet part 20 that is not involved in the printing so as to retreat from workpiece W.

Specifically, at least four ink jet parts 20 are provided, for example, corresponding to four colors of cyan (C), magenta (M), yellow (Y), and black (K).

Ink jet part 20 discharges droplet 25 toward workpiece W while moving in the main scanning direction. Ink jet part 20 prints an image on the surface of workpiece W with discharged droplet 25. At this time, workpiece drive unit 30 further relatively moves workpiece W with respect to ink jet part 20 as illustrated in FIG. 3. As a result, the image can be printed in a sub scanning direction (in FIG. 2, the horizontal direction (Y direction)) which is orthogonal to the main scanning direction.

Figure 4:
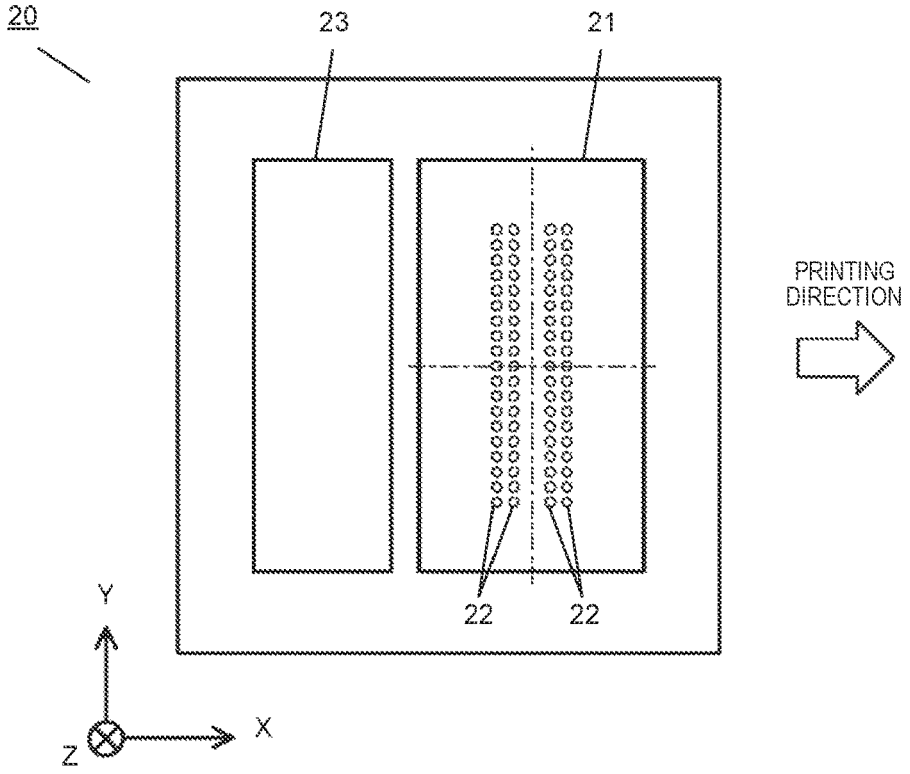
FIG. 4 is a plan view illustrating a configuration of an ink jet part of the same printing apparatus.

Next, ink jet part 20 of printing unit 10 will be described with reference to FIG. 4. FIG. 4 is a plan view illustrating a configuration of ink jet part 20 of printing apparatus 1.

As illustrated in FIG. 4, ink jet part 20 includes head part 21 and curing part 23. Head part 21 is provided with four nozzle rows arranged at predetermined intervals in the X direction. The nozzle row includes a plurality of nozzles 22 arranged in one row along the sub scanning direction (Y direction). A pitch between nozzles 22 adjacent to each other in the X direction is set to, for example, 150 dpi to 1200 dpi. A nozzle row having a plurality of nozzles 22 may be arranged side by side in two or more rows along the sub scanning direction.

In the example illustrated in FIG. 4, in order to explain the pitch between nozzles 22 in an easy-to-understand manner, an example is illustrated in which the plurality of nozzles 22 in the four nozzle rows are arranged side by side at the same position (overlapping position) when viewed from the printing direction, but the present disclosure is not limited to this. For example, the plurality of nozzles 22 in the four nozzle rows may be arranged with being shifted at positions where the plurality of nozzles 22 do not overlap each other when viewed from the printing direction. As a result, the resolution of printing can be increased.

Ink jet part 20 is configured by, for example, a piezo type device. Ink jet part 20 discharges a predetermined amount of droplets 25 vertically downward from nozzle 22, for example, toward the surface of workpiece W, in response to a drive signal supplied from controller 15.

In curing part 23, the ink or the coating material which is applied to the surface of workpiece W is cured. As curing part 23, it is appropriately selected from the following devices and the like depending on the type of ink and coating material to be applied. For example, as curing part 23, an ultraviolet light source such as a metal halide lamp or UV-LED, an infrared light source such as a halogen lamp, an infrared laser diode, or an infrared laser, a heat source by a heater, or the like can be used.

In Exemplary Embodiment 1, as illustrated in FIG. 4, the configuration in which ink jet part 20 includes head part 21 and one curing part 23 has been described as an example, but the present disclosure is not limited to this.

Figure 5:
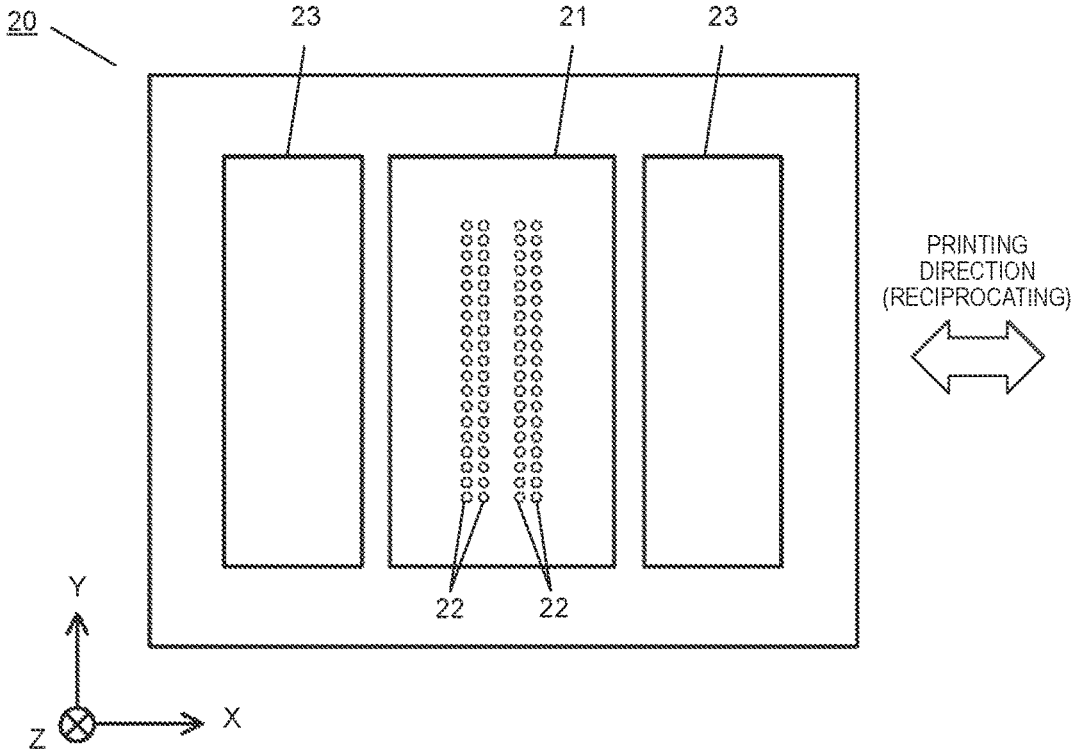
FIG. 5 is a plan view illustrating another configuration of the ink jet part of the same printing apparatus.

For example, as illustrated in FIG. 5, ink jet part 20 may include head part 21, and two curing parts 23 which are disposed on both sides of head part 21 in the main scanning direction (in FIG. 5, the horizontal direction (X direction)). With this configuration, the ink on workpiece W can be efficiently cured by using two curing parts 23 during a reciprocating motion of ink jet part 20 with respect to workpiece W.

Figure 6:
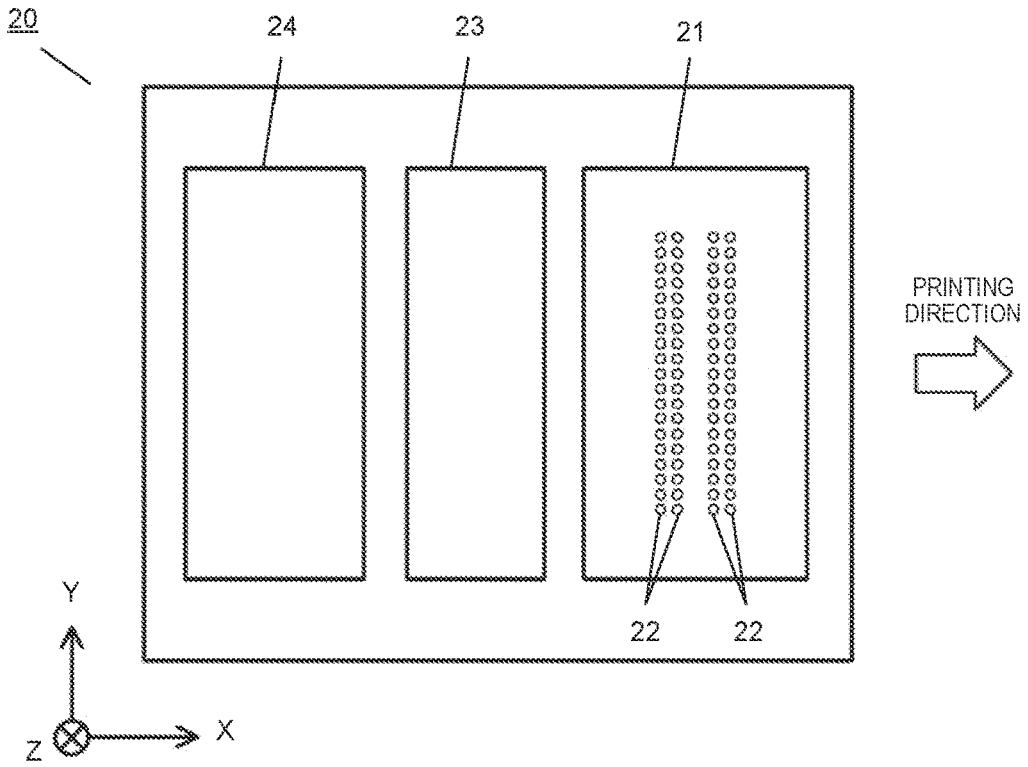
FIG. 6 is a plan view illustrating still another configuration of the ink jet part of the same printing apparatus.

Further, as illustrated in FIG. 6, ink jet part 20 may include head part 21, curing part 23, and distance measurement part 24. Distance measurement part 24 measures a distance between ink jet part 20 and workpiece W. Distance measurement part 24 is appropriately selected depending on the type of material constituting workpiece W. For example, as distance measurement part 24, a contact type probe, a non-contact type laser displacement meter, an ultrasonic displacement meter, an LED, or the like can be used. Distance measurement part 24 with the above described non-contact type measures a distance based on the time from when workpiece W is irradiated with light until the light returns to a light receiving element (not illustrated).

At this time, printing unit 10 of Exemplary Embodiment 1 is configured so as to measure a distance between workpiece W and printing unit 10 by distance measurement part 24 before printing by discharging droplet 25 onto workpiece W for the following reasons.

That is, when workpiece W is made of, for example, a resin molded product, a dimensional difference of ±1 mm or more may occur between workpiece W and printing unit 10 with respect to designed CAD data of a product.

Therefore, in printing unit 10 of Exemplary Embodiment 1, the distance between ink jet part 20 and workpiece W is measured in advance by distance measurement part 24. As a result, it is possible to prevent a collision between ink jet part 20 and workpiece W during printing in advance. Further, a printing gap, which is a distance that droplet 25 can reach reliably, can be appropriately set in advance.

In addition to measuring the distance between above described ink jet part 20 and workpiece W, a shape of workpiece W may be measured and the shape of workpiece W may be converted into surface data of workpiece W based on the measurement data of the shape by distance measurement part 24. As a result, the surface data of workpiece W can be used for the printing. Further, distance measurement part 24 may measure only a representative point of an area to be printed and appropriately change the printing gap based on information of the representative point. As a result, the time required for printing can be shortened.

The measurement of the distance between workpiece W and printing unit 10 may be obtained with the total number of components to be printed or may be performed by extracting the components to be printed. When workpiece W is made of a material having excellent dimensional stability, it is not necessary to particularly perform the measurement of the distance described above.

Figure 7:
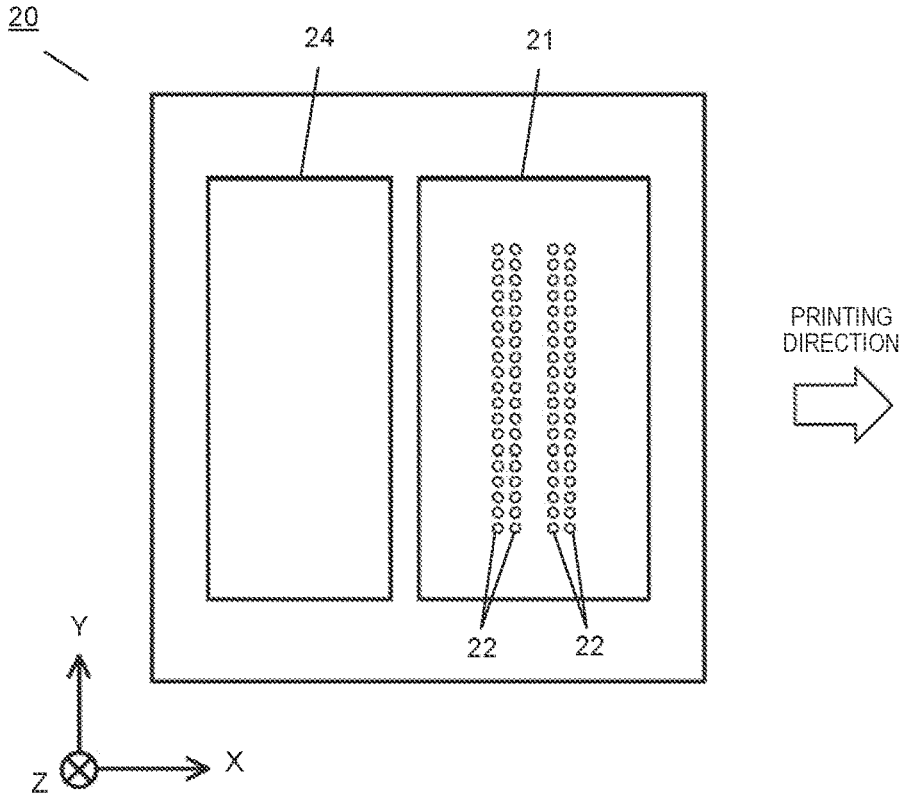
FIG. 7 is a plan view illustrating still another configuration of the ink jet part of the same printing apparatus.

Further, as illustrated in FIG. 7, ink jet part 20 may include only head part 21 and distance measurement part 24.

Ink jet part 20 may be configured such that curing part 23 and distance measurement part 24 are not provided, and only head part 21 is provided alone. As a result, the curved surface that ink jet part 20 can handle increases, the weight of ink jet part 20 can be reduced, and the device configuration can be simplified.

Ink jet part 20 may have a configuration having a plurality of head parts 21. In the case of a configuration having a plurality of head parts 21, not all head parts 21 need to have different colors, and a plurality of head parts 21 having the same color may be provided. As a result, for example, the amount of white ink that hides the base that is used in a large amount can be increased as compared with the inks of other colors, and the usage time can be extended. Further, when the curved surface is printed by two head parts 21 of the same color, the tact becomes shorter.

For example, it may be configured to further include ink jet part 20 of another color, so-called special color, such as light cyan (Lc) or light magenta (Lm) for improving the graininess of an image, green (G), orange (Or), red (R), or violet (V) for expanding the color reproduction region. As a result, the expressiveness of a product package to be printed or the appeal of the product can be improved. Further, it may be configured to add a plurality of color nozzle rows to head part 21 of one ink jet part 20. As a result, one head can handle a plurality of colors or materials, so that the size can be reduced.

When an image is formed on workpiece W of a medium whose base is not white, an ink jet part with white (W) is usually required. In this case, for example, the ink jet part with white (W) may be disposed separately from ink jet part 20 having four colors.

An ink jet part for a primer may be provided in order to impart adhesion to the base. An ink jet part for a clear may be provided in order to form an uneven texture or to form a protective layer on the coated color. Further, an ink jet part for a metallic material containing aluminum, gold, silver, copper, and the like may be provided. These ink jet parts do not necessarily have to be provided and may be appropriately disposed as needed. Examples of the desired combination of the ink jet parts described above include (1) cyan, magenta, yellow, and black, (2) white, cyan, magenta, yellow, and black, (3) white, cyan, magenta, yellow, black, and clear, (4) primer, cyan, magenta, yellow, black, and clear, (5) metallic, white, cyan, magenta, yellow, and black, and the like. Further, examples of the combinations include (6) white, cyan, magenta, yellow, black, light cyan, and light magenta, (7) primer, white, cyan, magenta, yellow, black, and clear, and the like. Furthermore, examples of the combinations include (8) metallic, white, cyan, magenta, yellow, black, and clear, (9) metallic, white, cyan, magenta, yellow, black, light cyan, and light magenta, (10) metallic, white, cyan, magenta, yellow, black, light cyan, light magenta, and clear, and the like.

The ink or the coating material of each of the above colors is made of, for example, a material that is cured by ultraviolet rays (UV). The ink or the coating material for a primer or a clear may be an ultraviolet type or a solvent type. Further, the ink or the coating material of the metallic material may be an ultraviolet type or a solvent type.

As described above, the ink or the coating material of each color is desirably a material that is cured by the ultraviolet rays (UV), but may be a solvent type. That is, the ink that hardens with ultraviolet rays enables drying in a short time. When it is a solvent type, the material can be easily designed, so that there is a possibility that more materials can be used to expand the applicable range.

Printing unit 10 of printing apparatus 1 is configured as described above.

Workpiece Drive Unit

Next, workpiece drive unit 30 of printing apparatus 1 will be described with reference to FIGS. 1 to 3.

As illustrated in FIGS. 1 to 3, workpiece drive unit 30 includes fixing jig 40 attached to a front end having a high degree of freedom of movement. Workpiece W is fixed to fixing jig 40. Workpiece drive unit 30 transports workpiece W fixed to fixing jig 40 below printing unit 10.

Workpiece drive unit 30 includes drive mechanisms of four axes. Two axes among the drive mechanisms of four axes are Y-axis linear motion mechanism 31 and Z-axis linear motion mechanism 32. The other two axes among the drive mechanisms of four axes are A-axis rotation mechanism 35 and B-axis rotation mechanism 36.

Y-axis linear motion mechanism 31 is mounted on frame 2. Y-axis linear motion mechanism 31 moves workpiece W in the sub scanning direction (Y direction).

Z-axis linear motion mechanism 32 is attached to Y-axis linear motion mechanism 31. Z-axis linear motion mechanism 32 moves workpiece W in the vertical direction (Z direction).

One end of A-axis rotation mechanism 35 is attached to Z-axis linear motion mechanism 32, and supporting arm 41 is attached to the other end of A-axis rotation mechanism 35. A-axis rotation mechanism 35 rotates workpiece W with the A-axis extending in the X direction from Z-axis linear motion mechanism 32 as the center of rotation via supporting arm 41.

B-axis rotation mechanism 36 is attached to A-axis rotation mechanism 35 via supporting arm 41. Fixing jig 40 is attached to B-axis rotation mechanism 36. B-axis rotation mechanism 36 rotates workpiece W with the B-axis extending in the Z direction from supporting arm 41 as the center of rotation.

Workpiece drive unit 30 operates Y-axis linear motion mechanism 31, Z-axis linear motion mechanism 32, A-axis rotation mechanism 35, and B-axis rotation mechanism 36 based on a signal from controller 15. As a result, workpiece drive unit 30 moves workpiece W fixed to fixing jig 40 below ink jet part 20. At this time, workpiece drive unit 30 moves workpiece W while adjusting a position and a position of workpiece W by using the drive mechanisms of four axes (see FIG. 3).

Workpiece drive unit 30 of printing apparatus 1 is configured as described above and moves workpiece W.

Controller

Next, controller 15 of printing apparatus 1 illustrated in FIG. 1 will be described.

Controller 15 is constituted by, for example, a personal computer, a programmable logic controller (PLC), or the like. Controller 15 controls the operations of printing unit 10 and workpiece drive unit 30.

Specifically, controller 15 controls an operation of the plurality of ink jet parts 20 with respect to printing unit 10 via X-axis linear motion mechanism 11. Further, controller 15 controls such that an appropriate amount of droplets 25 such as ink or coating material are discharged from head part 21 of ink jet part 20 of printing unit 10.

Further, controller 15 controls the operations of Y-axis linear motion mechanism 31, Z-axis linear motion mechanism 32, A-axis rotation mechanism 35, and B-axis rotation mechanism 36 with respect to workpiece drive unit 30.

Controller 15 of printing apparatus 1 is configured as described above.

Position and Orientation of Workpiece when Printing

Next, a position and an orientation of workpiece W when printing will be described with reference to FIG. 8.

Figure 8:
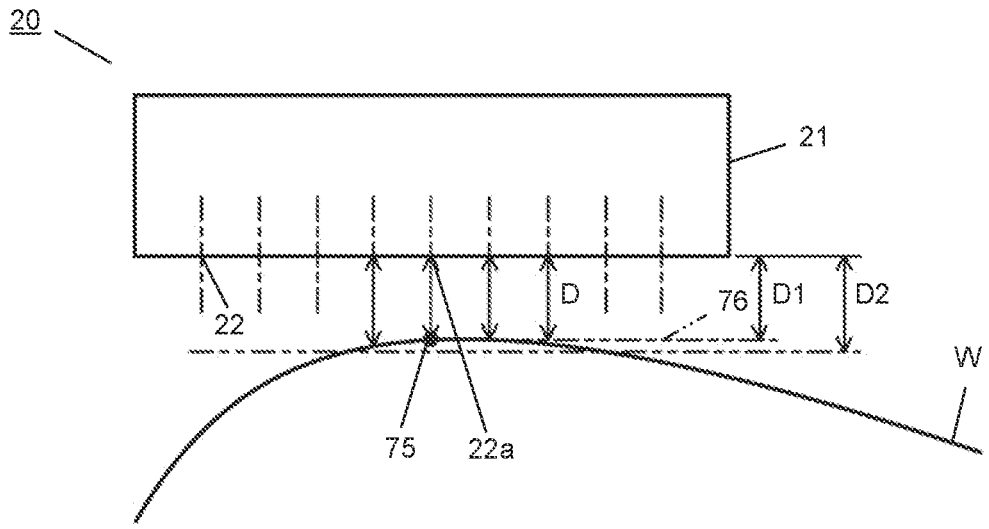
FIG. 8 is a view illustrating a distance between a nozzle of a head part of the same printing apparatus and a surface of the workpiece.

As illustrated in FIG. 8, among the plurality of nozzles 22 of ink jet part 20, a point where a perpendicular line drawn from nozzle 22*a* in the vicinity of the center toward the surface of workpiece W intersects with the surface of workpiece W, is defined as intersection 75. A point where a perpendicular line drawn from a point, in which a center line of head part 21 in the X direction and a center line of head part 21 in the Y direction intersect as illustrated by alternate long and short dash lines in FIG. 4, toward the surface of workpiece W intersects with the surface of workpiece W may be defined as intersection 75. As a result, a center position of head part 21 can be set as a center position of the locus, and the calculation can be performed in consideration of symmetry. Therefore, a printing track can be easily calculated by using each of all the nozzle rows.

At intersection 75, tangential line 76 with respect to the surface of workpiece W is parallel to a lower surface of ink jet part 20 (the surface on which nozzle 22 is disposed). A distance between nozzle 22 and the surface of workpiece W is defined as D.

As described above, controller 15 controls a drive of the drive mechanism which is constituted by Z-axis linear motion mechanism 32, Y-axis linear motion mechanism 31, A-axis rotation mechanism 35, and B-axis rotation mechanism 36. At this time, controller 15 controls the drive mechanism so that distance D1 between nozzle 22*a* in the vicinity of the center and intersection 75 on the surface of workpiece W, which is illustrated in FIG. 8, is substantially constant (including constant), and adjusts the position and the orientation of workpiece W.

Distance D1 is set to any value in the range of, for example, 0.3 mm to 7 mm. As described above, this range is a range in which droplet 25 can be stably applied. Distance D1 is not limited to the above range and can be changed as needed, such as a curved surface of workpiece W or the printing accuracy.

However, usually, there are portions having different curvatures on the surface of workpiece W. Therefore, even when controller 15 adjusts distance D1 between nozzle 22*a* in the vicinity of the center and intersection 75 on the surface of workpiece W to be substantially constant (including constant), the distance between nozzle 22 and the surface of workpiece W changes.

At this time, in a part where distance D between nozzle 22 and workpiece W is longer than a predetermined value, the time for droplet 25 to reach workpiece W becomes longer. Therefore, droplet 25 discharged from nozzle 22 is easily affected by the surrounding air flow and the like. As a result, a landing position of droplet 25 on workpiece W may shift, causing phenomena such as oozing, blurring, and color shift. That is, when droplet 25 cannot be accurately disposed at a predetermined position on a three-dimensional curved surface on the surface of workpiece W, the image quality of the printed image may deteriorate.

Figure 9:
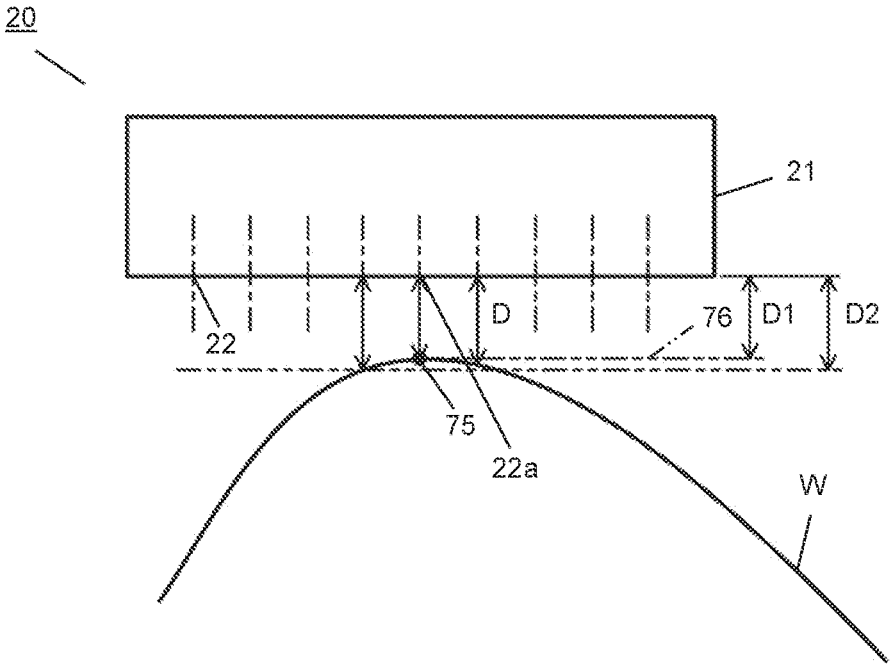
FIG. 9 is a view illustrating a distance between the nozzle of the head part and the surface of the workpiece when a position of the workpiece of the same printing apparatus is changed.

For example, a distance between left end nozzle 22 and workpiece W illustrated in FIG. 9 is longer than a distance between left end nozzle 22 and workpiece W illustrated in FIG. 8. Therefore, it is necessary to adjust the coating width of the nozzle row according to the curvature of the surface of workpiece W and dispose droplet 25 with high accuracy.

Controller 15 sets a coating region according to the following procedure based on the CAD data and the like. After that, controller 15 applies droplet 25 to the surface of workpiece W by changing the coating width of the nozzle row for each set coating region via ink jet part 20.

Hereinafter, the setting of the coating region will be specifically described with reference to FIGS. 10 to 14.

Figure 10:
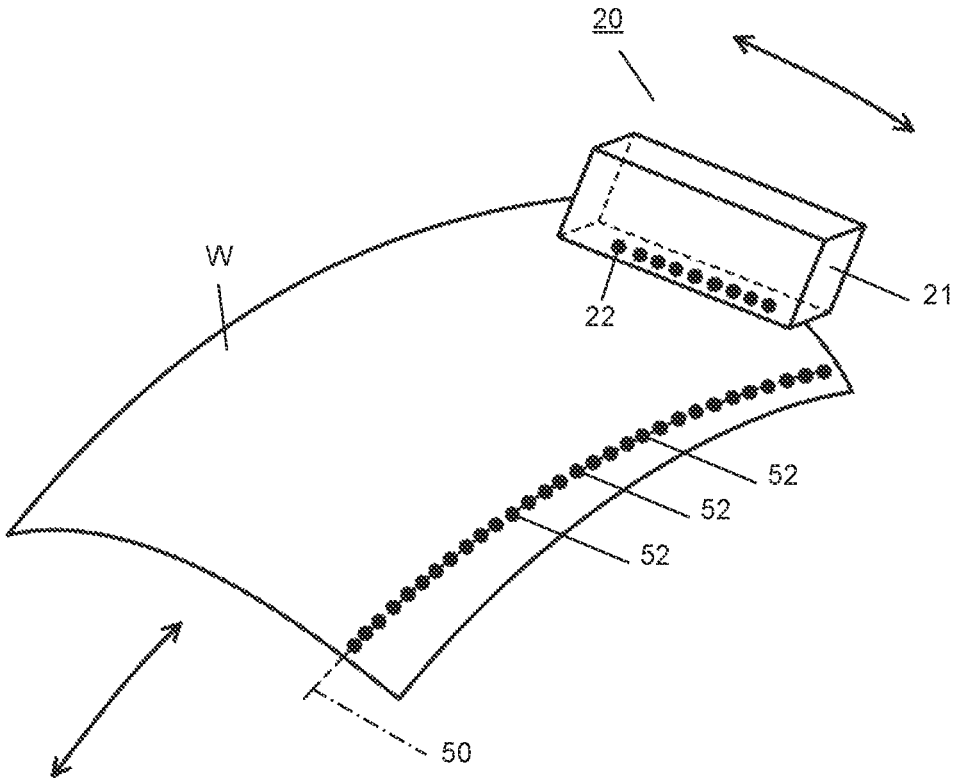
FIG. 10 is a perspective view illustrating a relationship between the workpiece of the same printing apparatus and a coating line.

First, as illustrated in FIG. 10, controller 15 sets coating line 50 on the surface of workpiece W. At this time, it is desirable that coating line 50 is set at a part on the surface of workpiece W that is close to the plane having the smallest curvature. That is, the difference in distance D can be reduced. Therefore, by applying the droplets from a part having a small curvature, it is possible to print using a wide printing width.

Figure 11:
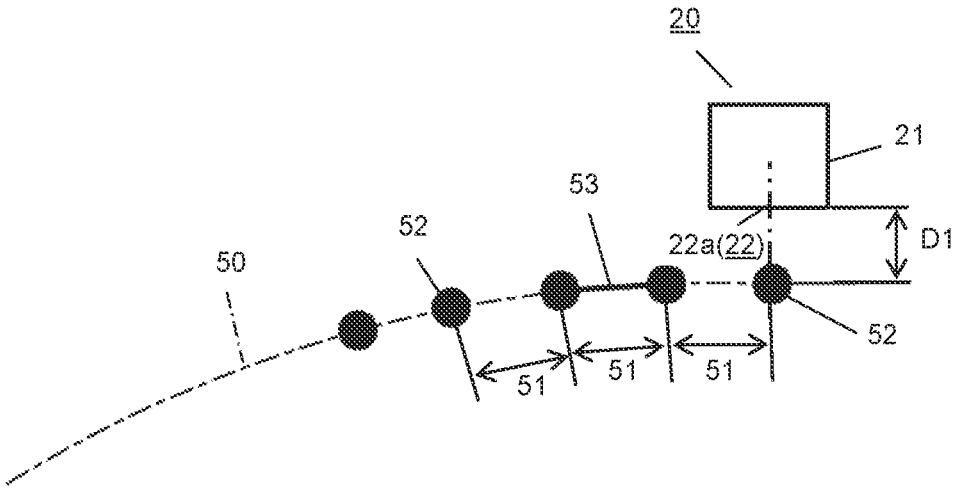
FIG. 11 is a side view illustrating a state in which a nozzle faces print coordinates of the workpiece of the same printing apparatus.

Next, as illustrated in FIG. 11, controller 15 sets a plurality of print coordinates 52 divided into equal pitches 51 on set coating line 50. Print coordinates 52 are calculated by using the CAD data according to the required necessary print resolution. At this time, for example, print coordinates 52 are desirably set at a pitch of the print resolution. Print coordinates 52 may be set at a pitch that is an integral multiple of the print resolution. As a result, it is possible to suppress an increase in the amount of data and shorten the printing time. Further, when it is set to an integral multiple, data complementation can be easily supplemented.

Next, controller 15 relatively moves ink jet part 20 with respect to workpiece W along set coating line 50. Specifically, ink jet part 20 is relatively moved with respect to workpiece W so that the perpendicular line, which is drawn from nozzle 22*a* in the vicinity of the center of head part 21 of ink jet part 20 toward the surface of workpiece W, coincides with print coordinates 52. At this time, controller 15 moves workpiece W while adjusting the position and the orientation so that distance D between nozzle 22 and the surface of workpiece W is substantially constant (including constant).

Figure 12:
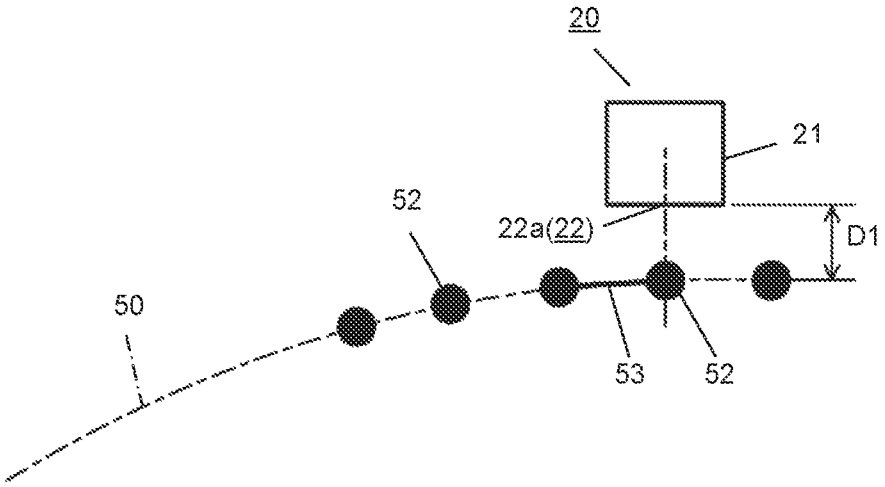
FIG. 12 is a side view illustrating a state in which a nozzle faces the next print coordinates of the workpiece of the same printing apparatus.

Next, as illustrated in FIG. 12, controller 15 controls the drive mechanism such that the inclination of line segment 53 connecting print coordinates 52 that faces nozzle 22 and next print coordinates 52 is set to near 0 (zero) (parallel and horizontal to the nozzle surface), and moves and rotates workpiece W. As a result, workpiece W changes from a state illustrated in FIG. 11 to a state illustrated in FIG. 12. In FIGS. 11 and 12, the tangential line of the curved surface at each of print coordinates 52 and the nozzle surface are parallel. The tangential line of the curved surface at print coordinates 52 is perpendicular to coating line 50.

Next, controller 15 relatively moves ink jet part 20 with respect to all print coordinates 52 on set coating line 50. After that, controller 15 selects only nozzle 22 whose distance D between nozzle 22 and the surface of workpiece W is within a certain range D2 at print coordinates 52 among the plurality of nozzles 22 (see FIGS. 8 and 9). Specifically, controller 15 selects only nozzle 22 whose distance D from the surface of workpiece W is within 5 mm, for example.

Figure 13:
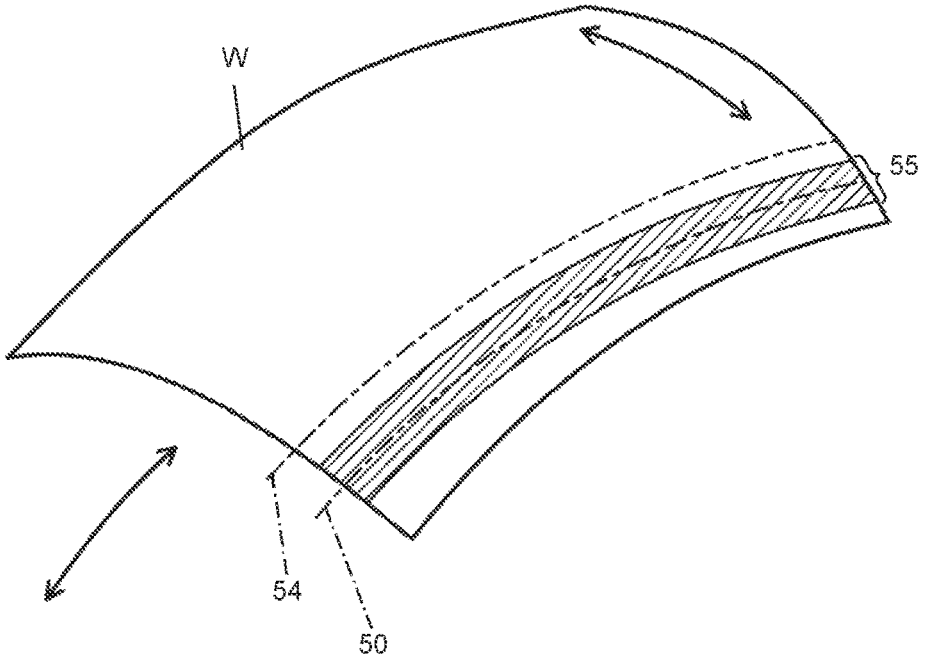
FIG. 13 is a perspective view illustrating a first region on a curved surface of the workpiece of the same printing apparatus.

At this time, as illustrated in FIG. 13, controller 15 sets a region that can be coated by selected nozzle 22 to first region 55. Specifically, first region 55 is set in a region interposed between two lines parallel to coating line 50.

Figure 14:
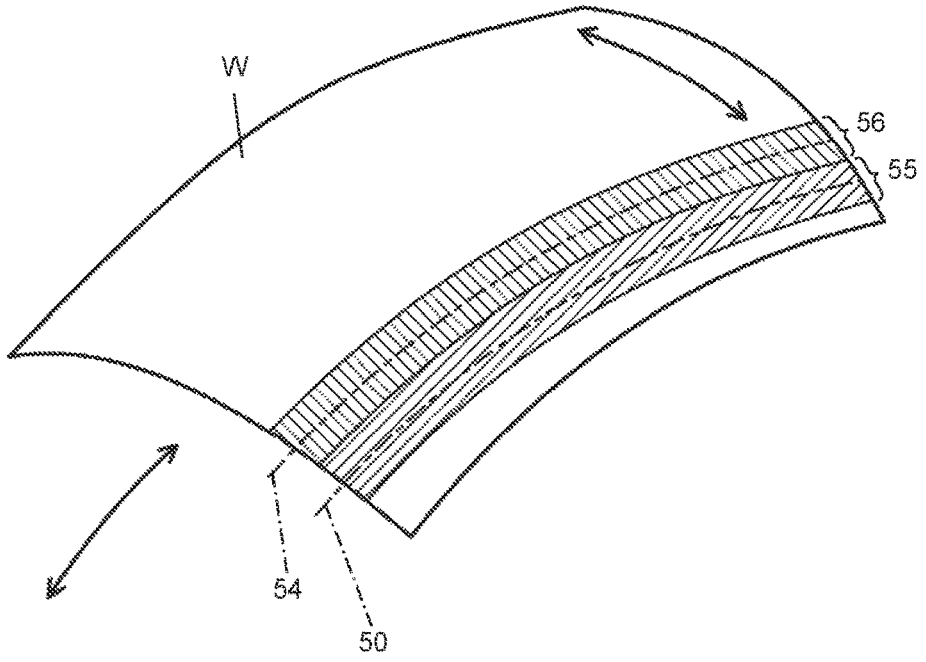
FIG. 14 is a perspective view illustrating the first region and a second region on the curved surface of the workpiece of the same printing apparatus.

Next, after first region 55 is set, controller 15 sets next coating line 54 at a position adjacent to first region 55, as illustrated in FIG. 14. The above-mentioned process is repeated, and a region interposed between the two lines parallel to coating line 54 is set as second region 56.

Further, controller 15 repeatedly sets the above process for a necessary coating region of workpiece W. After that, controller 15 applies droplet 25 for each set coating region via ink jet part 20.

At this time, when the curvature of the surface of each of the coating regions is different, the widths of the coating regions are different. Therefore, the number of nozzles 22 to be selected will also be different. At that time, controller 15 controls distance D between nozzle 22 and the surface of workpiece W so as to be within a certain range (D2). As a result, droplet 25 can be accurately applied to the coating region within distance D2 within a certain range via ink jet part 20.

When the coating region of workpiece W is divided into a plurality of regions, it is desirable to divide workpiece W so that no gap is formed between each of the coating regions. Therefore, controller 15 sets, for example, coating line 54 at an end portion of first region 55. As a result, no gap is formed between first region 55 and second region 56. However, even when a gap is formed between the coating regions, separately, another coating region may be provided so as to cover a part where the gap is formed, and then droplet 25 may be applied.

In the above description, when distance D between nozzle 22 and the surface of workpiece W is set, although the example described with reference to nozzle 22*a* in the vicinity of the center among the plurality of nozzles 22, another nozzle 22 may be used as a reference. For example, nozzles 22 disposed at both end portions of the nozzle row may be used as a reference. As a result, it is possible to set a region without a gap or a wide region in particular. Further, it may be configured such that droplet 25 is applied by using different nozzles 22 when setting the region and when coating. That is, for example, when a problem occurs in nozzle 22 that is used when setting a region, nozzle 22 that is used when setting a region is offset when coating instead of using nozzle 22 that is used when setting a region in the region. As a result, even when a problem occurs in nozzle 22, it can be easily dealt with.

When the curvature of the surface of workpiece W is large, nozzle 22 which is used less frequently may be generated. In that case, it is desirable that nozzle 22 that is not used for a certain period of time is configured to perform dummy coating. As a result, unused nozzle 22 can be appropriately cleaned to properly maintain a state of nozzle 22.

As described above, printing apparatus 1 of Exemplary Embodiment 1 can draw a pattern on workpiece W having a curved surface with high accuracy. That is, printing apparatus 1 of Exemplary Embodiment 1 can be used for forming a design for the external appearance of a product, drawing a wiring pattern on a three-dimensional surface, or the like.

Exemplary Embodiment 2

Hereinafter, a schematic configuration of printing apparatus 1 of Exemplary Embodiment 2 of the present disclosure will be described based on FIG. 15.

Figure 15:
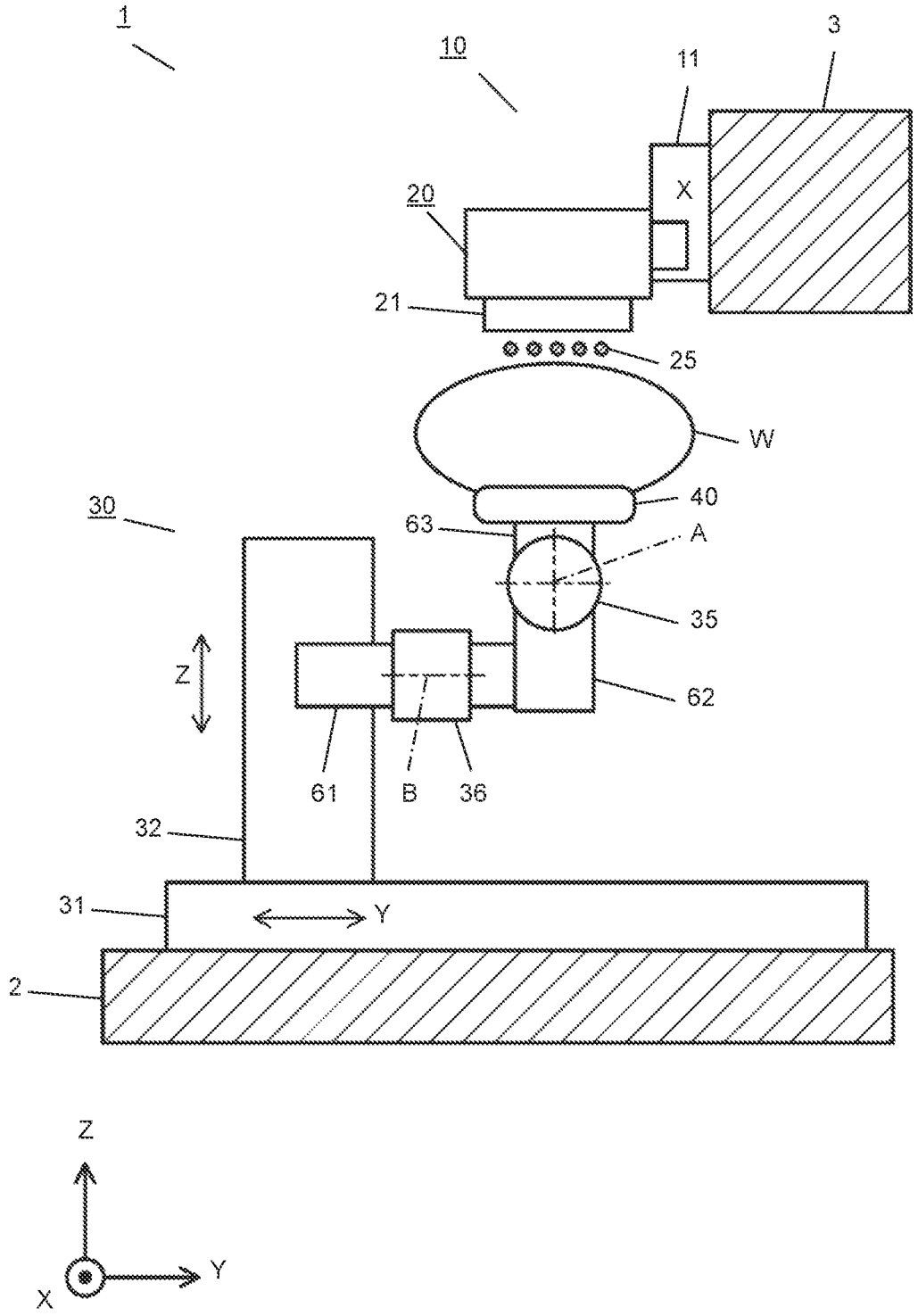
FIG. 15 is a side view illustrating a schematic configuration of a printing apparatus according to Exemplary Embodiment 2.

FIG. 15 is a side view illustrating a schematic configuration of printing apparatus 1 according to Exemplary Embodiment 2. Hereinafter, the same parts as those in Exemplary Embodiment 1 are designated by the same reference numerals, and only the differences will be described.

As illustrated in FIG. 15, printing unit 10 of printing apparatus 1 of Exemplary Embodiment 2 includes X-axis linear motion mechanism 11 which is a drive mechanism of one axis and a plurality of ink jet parts 20.

Workpiece drive unit 30 includes drive mechanisms of four axes. Two axes among the drive mechanisms of four axes are Y-axis linear motion mechanism 31 and Z-axis linear motion mechanism 32. The other two axes among the drive mechanisms of four axes are A-axis rotation mechanism 35 and B-axis rotation mechanism 36.

One end of B-axis rotation mechanism 36 is attached to Z-axis linear motion mechanism 32 via first arm 61. B-axis rotation mechanism 36 rotates workpiece W with the B-axis extending in the Y direction from Z-axis linear motion mechanism 32 as the center of rotation.

A-axis rotation mechanism 35 is attached to B-axis rotation mechanism 36 via second arm 62. Fixing jig 40 is attached to A-axis rotation mechanism 35 via third arm 63. A-axis rotation mechanism 35 rotates workpiece W with A-axis extending in the X direction from second arm 62 as the center of rotation.

With the configuration of workpiece drive unit 30, among the plurality of ink jet parts 20, only ink jet part 20 including a material that is a printing target can be printed close to workpiece W. As a result, it is possible to prevent the other ink jet part 20 from interfering with workpiece W. As a result, the degree of freedom in a position adjustment motion of workpiece W can be further increased.

Exemplary Embodiment 3

Hereinafter, a schematic configuration of printing apparatus 1 of Exemplary Embodiment 3 of the present disclosure will be described based on FIG. 16.

Figure 16:
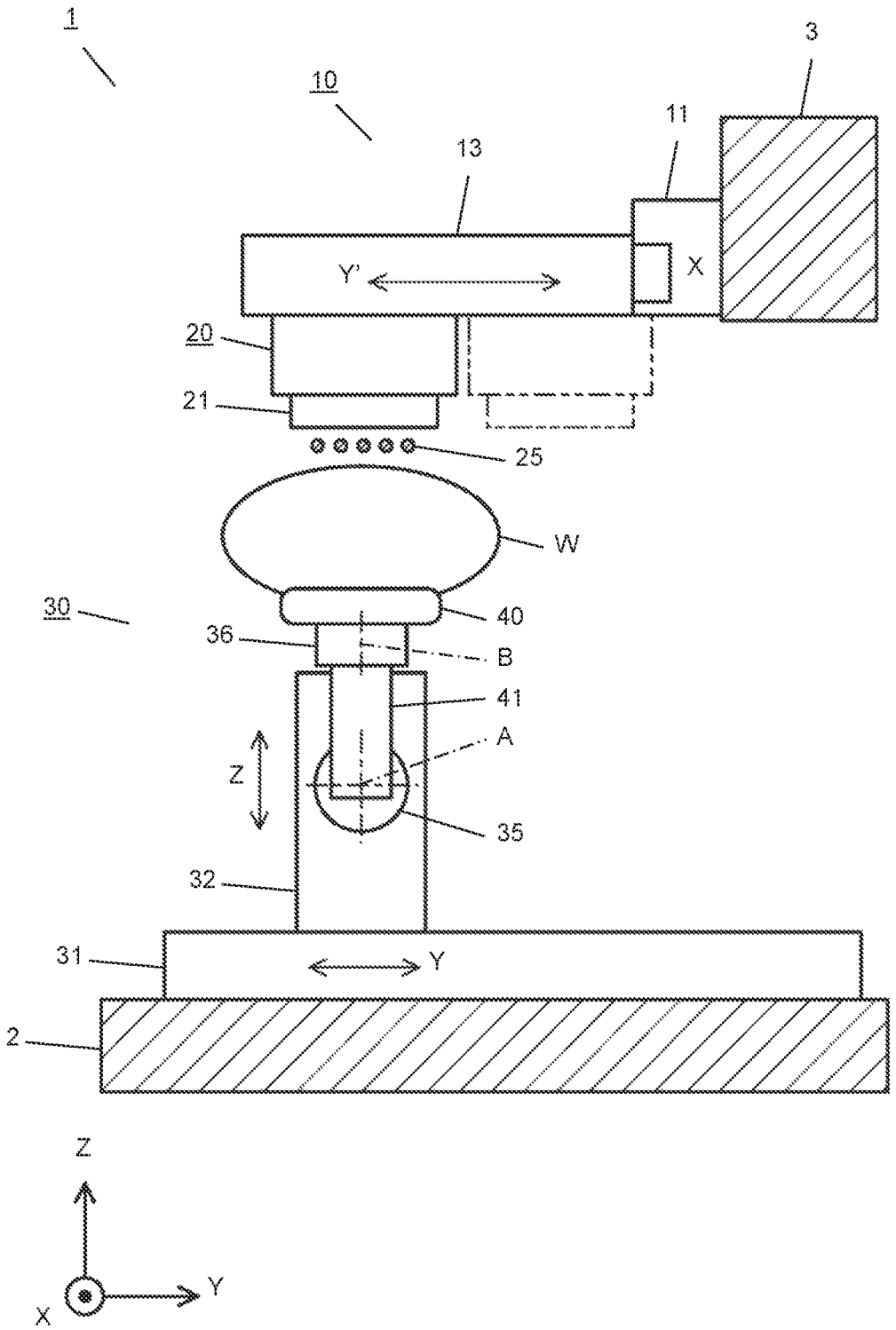
FIG. 16 is a side view illustrating a schematic configuration of a printing apparatus according to Exemplary Embodiment 3.

FIG. 16 is a side view illustrating a schematic configuration of printing apparatus 1 according to Exemplary Embodiment 3. Hereinafter, the same parts as those in Exemplary Embodiment 1 are designated by the same reference numerals, and only the differences will be described.

As illustrated in FIG. 16, printing unit 10 of printing apparatus 1 of Exemplary Embodiment 3 includes drive mechanisms of two axes and a plurality of ink jet parts 20. The drive mechanisms of two axes includes X-axis linear motion mechanism 11 and a plurality of Y'-axis linear motion mechanisms 13 (sub scanning linear motion mechanism).

The plurality of Y'-axis linear motion mechanisms 13 are provided corresponding to each of the plurality of ink jet parts 20. The plurality of Y'-axis linear motion mechanisms 13 are attached to X-axis linear motion mechanism 11. Each of the plurality of ink jet parts 20 is attached to X-axis linear motion mechanism 11 via corresponding each of Y'-axis linear motion mechanisms 13.

The plurality of Y'-axis linear motion mechanisms 13 move at least one of the plurality of ink jet parts 20 in the sub scanning direction (Y direction). That is, for example, among the plurality of ink jet parts 20, only ink jet part 20 including the material (color, raw material, or the like) that is a printing target is moved in the sub scanning direction by the corresponding Y'-axis linear motion mechanism 13.

Workpiece drive unit 30 includes drive mechanisms of four axes. Two axes among the drive mechanisms of four axes are Y-axis linear motion mechanism 31 and Z-axis linear motion mechanism 32. The other two axes among the drive mechanisms of four axes are A-axis rotation mechanism 35 and B-axis rotation mechanism 36.

With the configuration of Exemplary Embodiment 3, among the plurality of ink jet parts 20, only ink jet part 20 including a material that is a printing target can be printed close to workpiece W. As a result, it is possible to prevent the other ink jet part 20 from interfering with workpiece W. As a result, the degree of freedom in a position adjustment motion of workpiece W can be further increased.

Exemplary Embodiment 4

Hereinafter, a schematic configuration of printing apparatus 1 of Exemplary Embodiment 4 of the present disclosure will be described based on FIG. 17.

Figure 17:
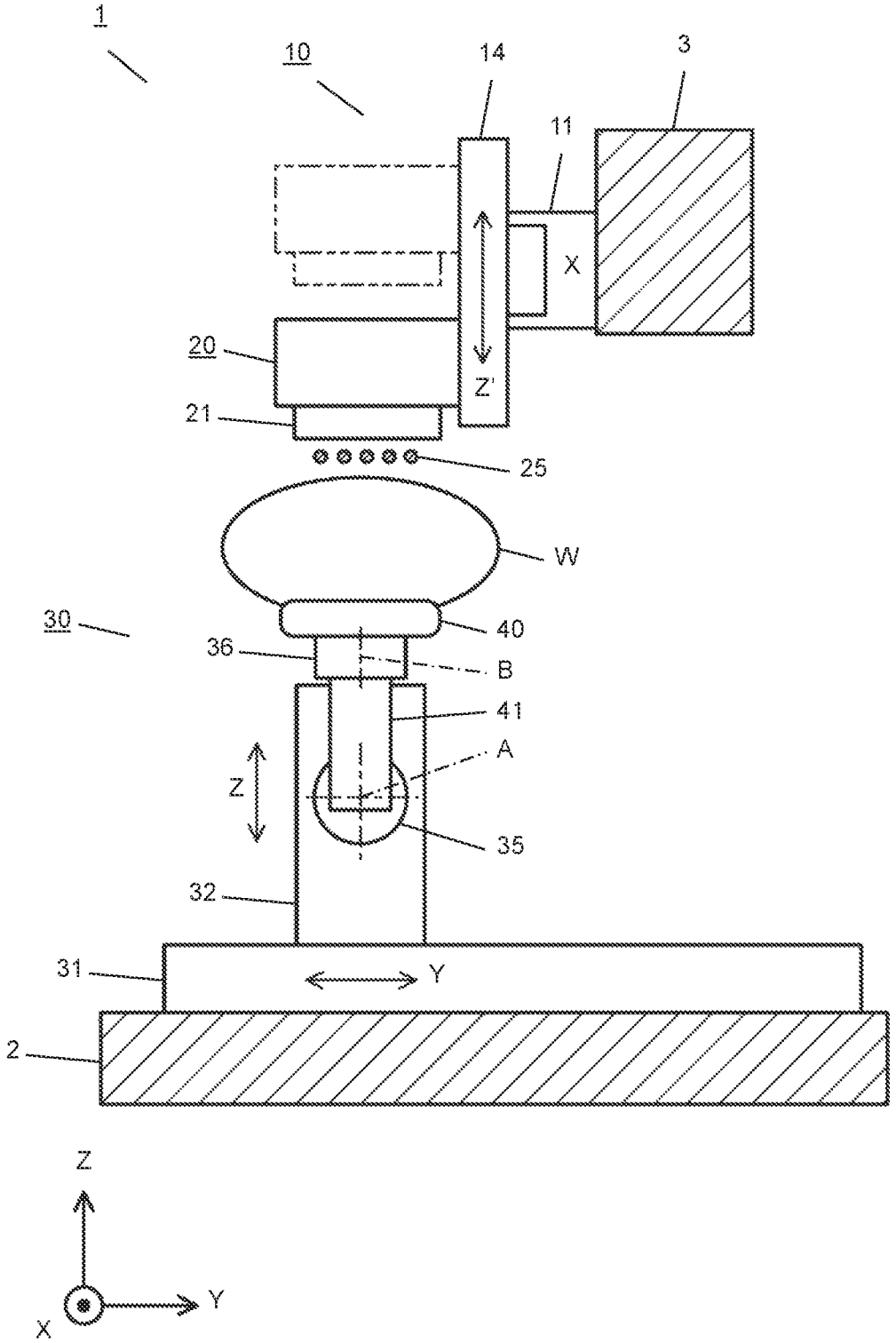
FIG. 17 is a side view illustrating a schematic configuration of a printing apparatus according to Exemplary Embodiment 4.

FIG. 17 is a side view illustrating a schematic configuration of printing apparatus 1 according to Exemplary Embodiment 4. Hereinafter, the same parts as those in Exemplary Embodiment 1 are designated by the same reference numerals, and only the differences will be described.

As illustrated in FIG. 17, printing unit 10 of printing apparatus 1 of Exemplary Embodiment 4 includes drive mechanisms of two axes and a plurality of ink jet parts 20. The drive mechanisms of two axes includes X-axis linear motion mechanism 11 and a plurality of Z'-axis linear motion mechanisms 14 (forward and backward linear motion mechanism).

The plurality of Z'-axis linear motion mechanisms 14 are provided corresponding to each of the plurality of ink jet parts 20. The plurality of Z'-axis linear motion mechanisms 14 are attached to X-axis linear motion mechanism 11. Each of the plurality of ink jet parts 20 is attached to X-axis linear motion mechanism 11 via corresponding each of Z'-axis linear motion mechanisms 14.

The plurality of Z'-axis linear motion mechanisms 14 move at least one of the plurality of ink jet parts 20 forward and backward in the Z direction with respect to workpiece W. That is, for example, among the plurality of ink jet parts 20, only ink jet part 20 including the material (color, raw material, or the like) that is a printing target is moved downward by the corresponding Z'-axis linear motion mechanism 14.

Workpiece drive unit 30 includes drive mechanisms of four axes. Two axes among the drive mechanisms of four axes are Y-axis linear motion mechanism 31 and Z-axis linear motion mechanism 32. The other two axes among the drive mechanisms of four axes are A-axis rotation mechanism 35 and B-axis rotation mechanism 36.

With the configuration of Exemplary Embodiment 4, among the plurality of ink jet parts 20, only ink jet part 20 including a material that is a printing target can be printed close to workpiece W. As a result, it is possible to prevent the other ink jet part 20 from interfering with workpiece W. As a result, the degree of freedom in a position adjustment motion of workpiece W can be further increased.

Further, even when the surface of workpiece W has a recessed portion, only the corresponding ink jet part 20 can be brought close to the recessed portion to discharge droplet 25. As a result, it is possible to draw a pattern on workpiece W with high accuracy.

Exemplary Embodiment 5

Hereinafter, a schematic configuration of printing apparatus 1 of Exemplary Embodiment 5 of the present disclosure will be described based on FIG. 18.

Figure 18:
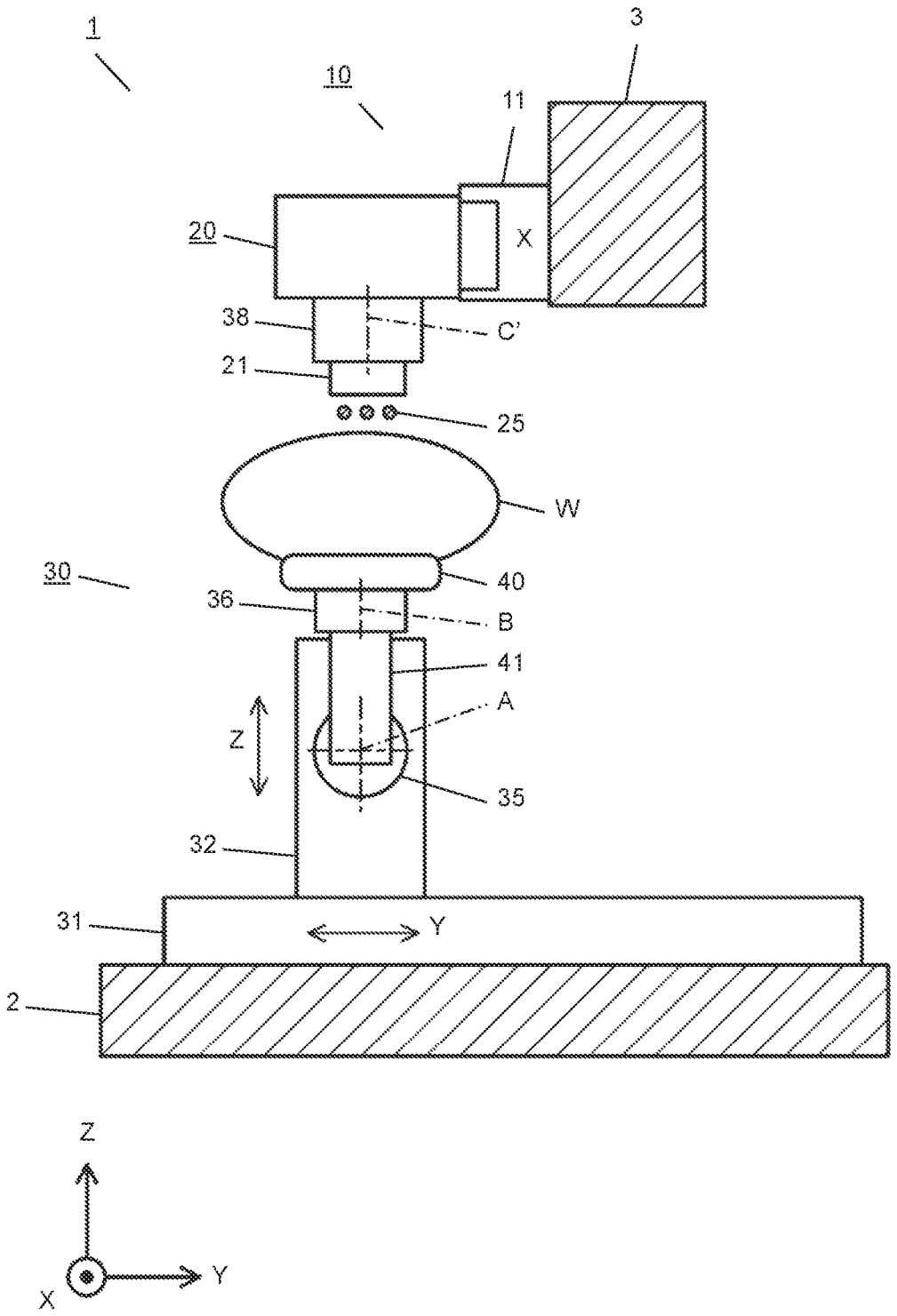
FIG. 18 is a side view illustrating a schematic configuration of a printing apparatus according to Exemplary Embodiment 5.

FIG. 18 is a side view illustrating a schematic configuration of printing apparatus 1 according to Exemplary Embodiment 5. Hereinafter, the same parts as those in Exemplary Embodiment 1 are designated by the same reference numerals, and only the differences will be described.

As illustrated in FIG. 18, printing unit 10 of printing apparatus 1 of Exemplary Embodiment 4 includes drive mechanisms of two axes and a plurality of ink jet parts 20. The drive mechanisms of two axes includes X-axis linear motion mechanism 11 and a plurality of C'-axis rotation mechanisms 38.

The plurality of C'-axis rotation mechanisms 38 are provided corresponding to each of the plurality of ink jet parts 20. The plurality of C'-axis rotation mechanisms 38 are attached to X-axis linear motion mechanism 11. Each of the plurality of ink jet parts 20 is attached to X-axis linear motion mechanism 11 via corresponding each of C'-axis rotation mechanisms 38. The C'-axis rotation mechanism 38 rotates head part 21 in the horizontal direction with C'-axis extending in the Z direction as the center of rotation.

Workpiece drive unit 30 includes drive mechanisms of four axes. Two axes among the drive mechanisms of four axes are Y-axis linear motion mechanism 31 and Z-axis linear motion mechanism 32. The other two axes among the drive mechanisms of four axes are A-axis rotation mechanism 35 and B-axis rotation mechanism 36.

According to the configuration of Exemplary Embodiment 5, ink jet part 20 can be moved in the main scanning direction by X-axis linear motion mechanism 11 and a position of nozzle 22 of head part 21 with respect to workpiece W can be finely adjusted in the horizontal direction by C'-axis rotation mechanism 38.

Specifically, for example, rows of a plurality of nozzles 22 arranged in one row along the sub scanning direction of ink jet part 20 are formed in a position inclined obliquely with respect to the main scanning direction. As a result, the pitch between nozzles 22 can be reduced and the print resolution can be increased.

The printing direction can be changed by rotating the row of nozzles 22 of ink jet part 20 by 90° with respect to the main scanning direction. As a result, the landing accuracy of droplet 25 can be improved.

Exemplary Embodiment 6

Hereinafter, a schematic configuration of printing apparatus 1 of Exemplary Embodiment 6 of the present disclosure will be described based on FIG. 19.

Figure 19:
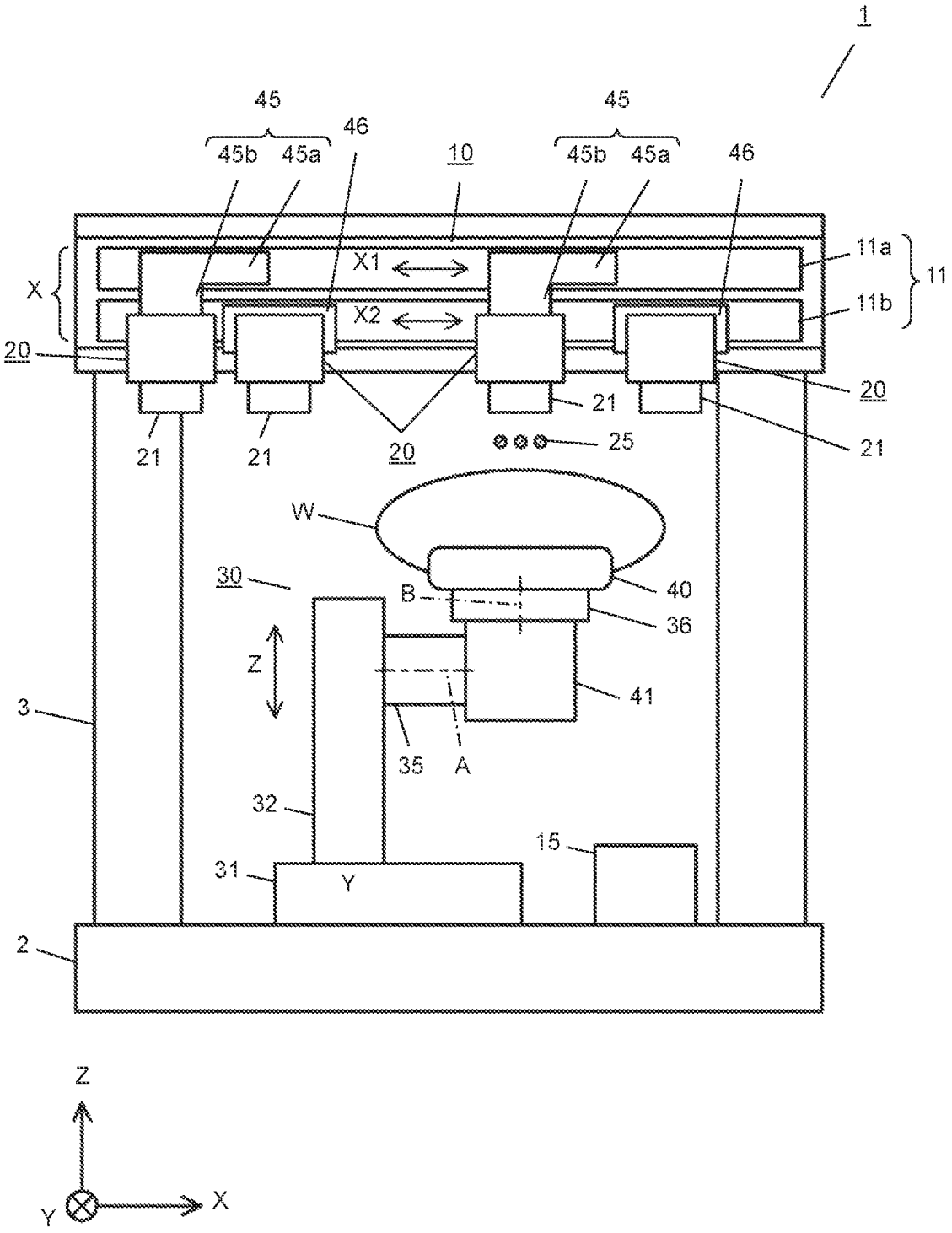
FIG. 19 is a front view illustrating a schematic configuration of a printing apparatus according to Exemplary Embodiment 6.

FIG. 19 is a front view illustrating a schematic configuration of printing apparatus 1 according to Exemplary Embodiment 6. Hereinafter, the same parts as those in Exemplary Embodiment 1 are designated by the same reference numerals, and only the differences will be described.

As illustrated in FIG. 19, workpiece drive unit 30 of printing apparatus 1 of Exemplary Embodiment 6 includes drive mechanisms of four axes. Two axes among the drive mechanisms of four axes are Y-axis linear motion mechanism 31 and Z-axis linear motion mechanism 32. The other two axes among the drive mechanisms of four axes are A-axis rotation mechanism 35 and B-axis rotation mechanism 36.

Printing unit 10 includes X-axis linear motion mechanism 11 and a plurality of ink jet parts 20.

X-axis linear motion mechanism 11 includes first X-axis linear motion mechanism 11*a* (first main scanning linear motion mechanism) and second X-axis linear motion mechanism 11*b* (second main scanning linear motion mechanism). First X-axis linear motion mechanism 11*a* and second X-axis linear motion mechanism 11*b* are disposed in parallel with each other in the X direction. First X-axis linear motion mechanism 11*a* is disposed more upward than second X-axis linear motion mechanism 11*b*.

For example, two ink jet parts 20 are attached to first X-axis linear motion mechanism 11*a*. Specifically, ink jet part 20 is attached to first X-axis linear motion mechanism 11*a* via first supporting member 45.

First supporting member 45 includes horizontal part 45*a* extending along first X-axis linear motion mechanism 11*a* in the horizontal direction and vertical part 45*b* extending downward from a left end portion of horizontal part 45*a*. Ink jet part 20 is attached to a lower end portion of vertical part 45*b*.

On the other hand, for example, two ink jet parts 20 are attached to second X-axis linear motion mechanism 11*b*. Ink jet part 20 is attached to second X-axis linear motion mechanism 11*b* via second supporting member 46. Second supporting member 46 extends along second X-axis linear motion mechanism 11*b* in the horizontal direction.

Four ink jet parts 20 are arranged so as to line up in the X direction. Four ink jet parts 20 are alternately attached to first X-axis linear motion mechanism 11*a* and second X-axis linear motion mechanism 11*b*.

Specifically, ink jet part 20 which is first from the left in FIG. 19 is attached to first X-axis linear motion mechanism 11*a* via first supporting member 45. Ink jet part 20 which is second from the left is attached to second X-axis linear motion mechanism 11*b* via second supporting member 46.

Ink jet part 20 which is third from the left in FIG. 19 is attached to first X-axis linear motion mechanism 11*a* via first supporting member 45. Ink jet part 20 which is fourth from the left is attached to second X-axis linear motion mechanism 11*b* via second supporting member 46.

Each of the nozzle surfaces of four ink jet parts 20 is disposed at positions on substantially the same plane (including on the same plane).

With the above configuration, the entire length of printing apparatus 1 in the X direction can be reduced as described below with reference to FIG. 20.

Figure 20:
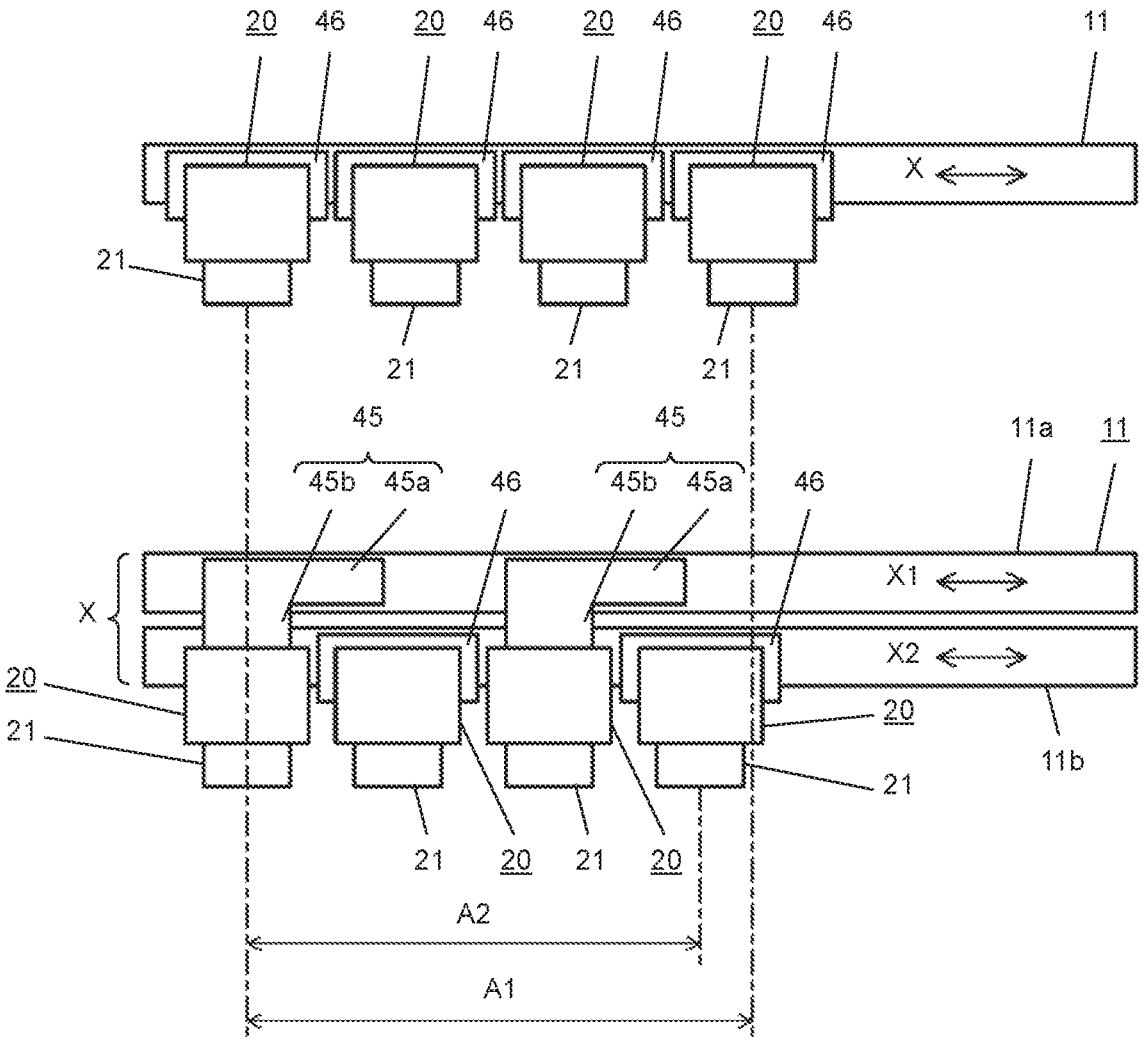
FIG. 20 is a view for explaining dispositions of a plurality of ink jet parts when an X-axis linear motion mechanism of Exemplary Embodiment 6 is in one row or two rows.

That is, as illustrated in the upper part in FIG. 20, when X-axis linear motion mechanism 11 is in one row, each of four ink jet parts 20 is held by X-axis linear motion mechanism 11 by second supporting member 46. Therefore, when four ink jet parts 20 are moved to the left side in a state where second supporting members 46 maintain gaps that do not interfere with each other, a distance between the center of ink jet part 20 positioned at the left end and the center of ink jet part 20 positioned at the right end is A1.

On the other hand, as illustrated in the lower part in FIG. 20, X-axis linear motion mechanism 11 of Exemplary Embodiment 6 is configured by two rows in which first X-axis linear motion mechanism 11*a* and second X-axis linear motion mechanism 11*b* are disposed in parallel with each other in the Z direction. Ink jet parts 20 which are first and third from the left are attached to first X-axis linear motion mechanism 11*a* via first supporting member 45. On the other hand, ink jet parts 20 which are second and fourth from the left are attached to second X-axis linear motion mechanism 11*b* via second supporting member 46.

Vertical part 45*b* of first supporting member 45 is configured to have a shape smaller than the horizontal width of ink jet part 20 in the X direction. Therefore, when moving while maintaining a gap that does not interfere with two ink jet parts 20 held by first supporting member 45 and two ink jet parts 20 held by second supporting member 46 of four ink jet parts 20, a distance between the center of ink jet part 20 positioned at the left end and the center of ink jet part 20 positioned at the right end is A2.

As a result, it becomes A2<A1.

That is, the gap between ink jet part 20 attached to first X-axis linear motion mechanism 11*a* and ink jet part 20 attached to second X-axis linear motion mechanism 11*b* can be set small. As a result, the entire length of printing apparatus 1 in the X direction can be reduced.

Exemplary Embodiment 7

Hereinafter, a schematic configuration of printing apparatus 1 of Exemplary Embodiment 7 of the present disclosure will be described based on FIG. 21.

Figure 21:
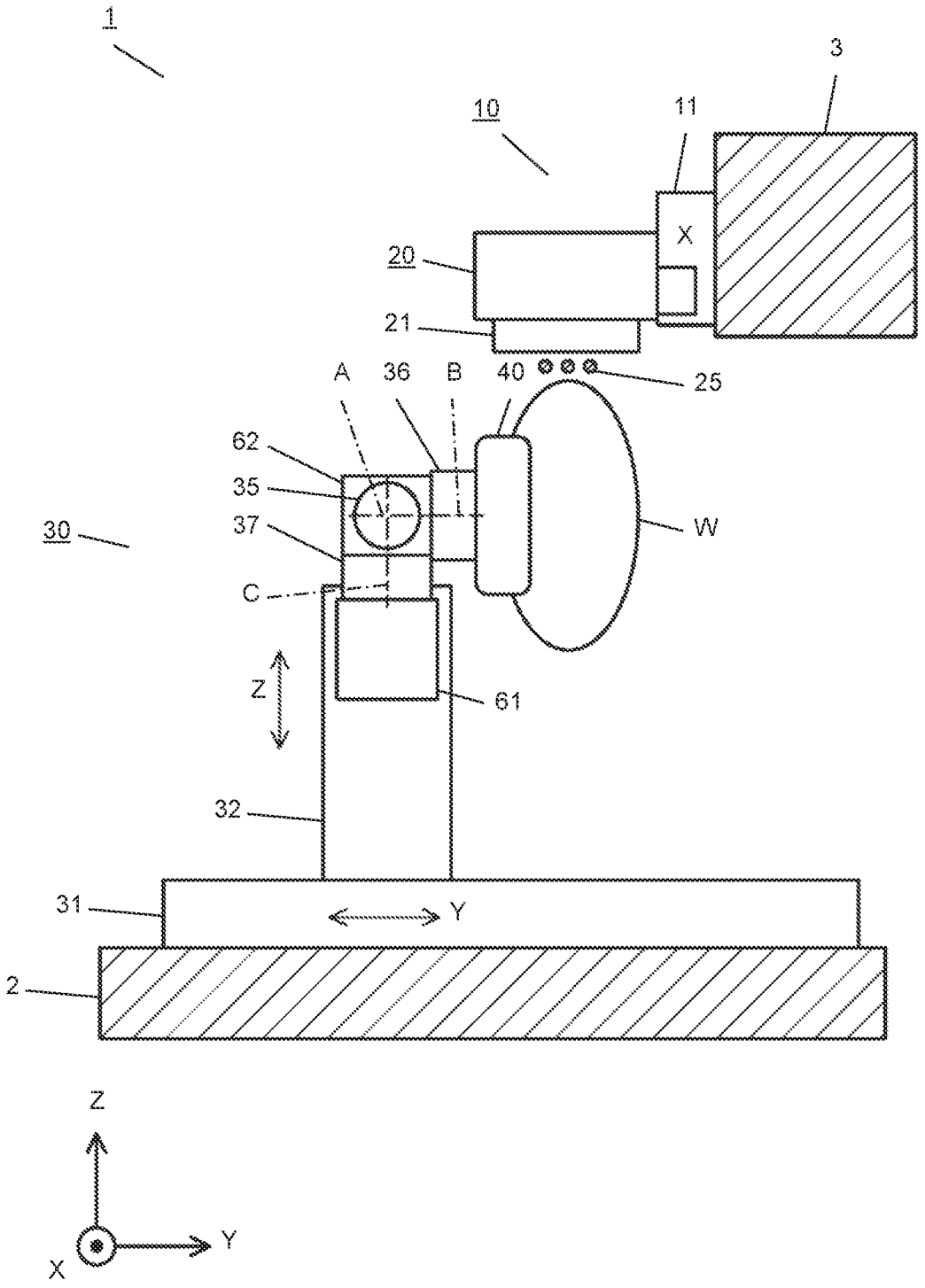
FIG. 21 is a side view illustrating a schematic configuration of a printing apparatus according to Exemplary Embodiment 7.

FIG. 21 is a side view illustrating a schematic configuration of printing apparatus 1 according to Exemplary Embodiment 7. Hereinafter, the same parts as those in Exemplary Embodiment 1 are designated by the same reference numerals, and only the differences will be described.

As illustrated in FIG. 21, printing unit 10 of printing apparatus 1 of Exemplary Embodiment 7 includes X-axis linear motion mechanism 11 and a plurality of ink jet parts 20.

Workpiece drive unit 30 includes drive mechanisms of five axes. Two axes among the drive mechanisms of five axes are Y-axis linear motion mechanism 31 and Z-axis linear motion mechanism 32. The other three axes among the drive mechanisms of five axes are A-axis rotation mechanism 35, B-axis rotation mechanism 36, and C-axis rotation mechanism 37.

C-axis rotation mechanism 37 is attached to Z-axis linear motion mechanism 32 via first arm 61. C-axis rotation mechanism 37 rotates workpiece W with C-axis extending in the Z direction from first arm 61 as the center of rotation.

A-axis rotation mechanism 35 is attached to C-axis rotation mechanism 37 via second arm 62. A-axis rotation mechanism 35 rotates workpiece W with A-axis extending in the X direction from second arm 62 as the center of rotation.

B-axis rotation mechanism 36 is attached to A-axis rotation mechanism 35 via an arm (not illustrated). Fixing jig 40 is attached to B-axis rotation mechanism 36. B-axis rotation mechanism 36 rotates workpiece W with the B-axis extending in the Y direction as the center of rotation.

According to the configuration of Exemplary Embodiment 7, the number of drive mechanisms of workpiece drive unit 30 can be increased. As a result, the adjustment range of the position of workpiece W can be further widened.

Exemplary Embodiment 8

Hereinafter, a schematic configuration of printing apparatus 1 of Exemplary Embodiment 8 of the present disclosure will be described based on FIG. 22.

Figure 22:
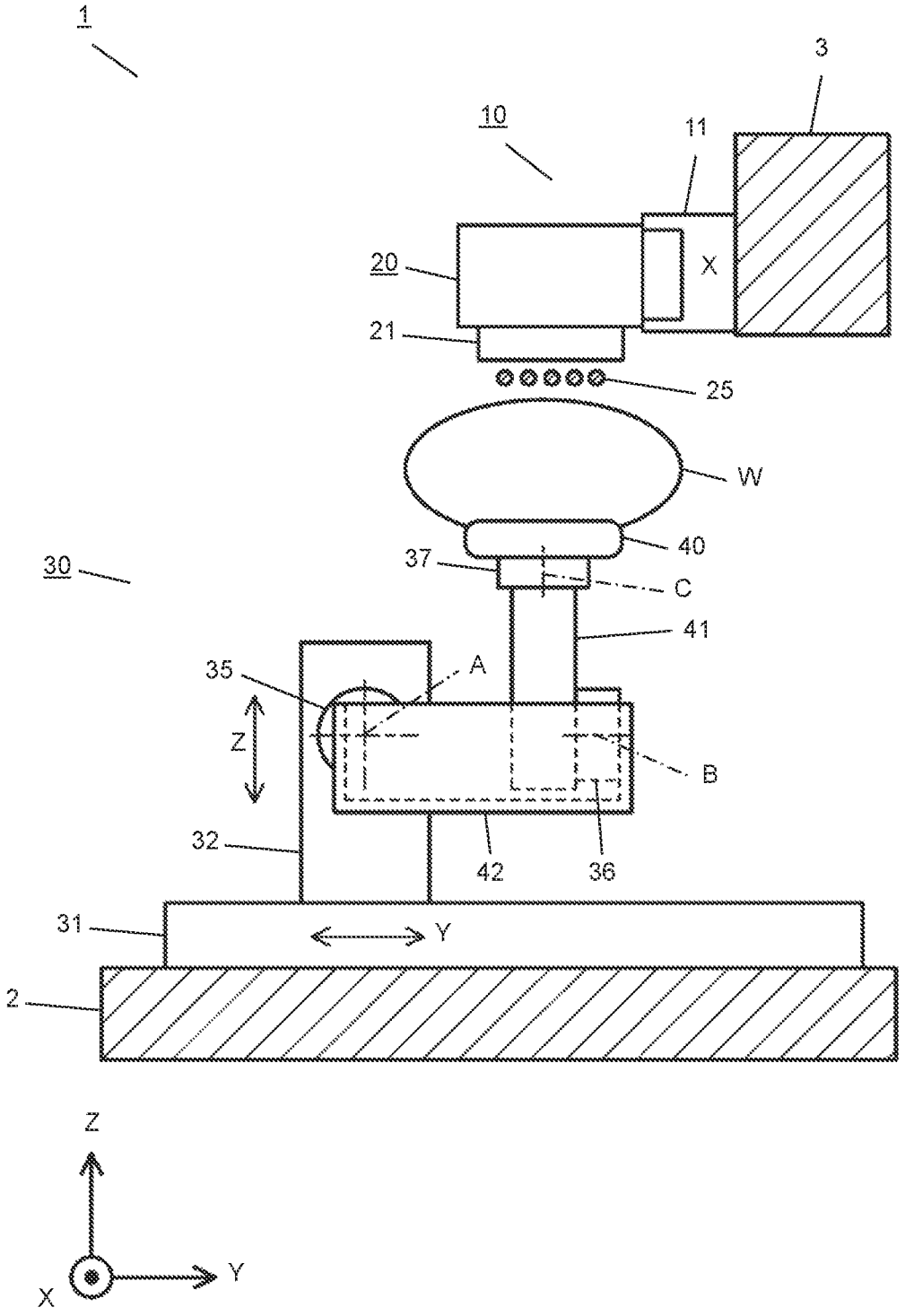
FIG. 22 is a side view illustrating a schematic configuration of a printing apparatus according to Exemplary Embodiment 8.

FIG. 22 is a side view illustrating a schematic configuration of printing apparatus 1 according to Exemplary Embodiment 8. Hereinafter, the same parts as those in Exemplary Embodiment 1 are designated by the same reference numerals, and only the differences will be described.

As illustrated in FIG. 22, printing unit 10 of printing apparatus 1 of Exemplary Embodiment 8 includes X-axis linear motion mechanism 11 and a plurality of ink jet parts 20.

Workpiece drive unit 30 includes drive mechanisms of five axes. Two axes among the drive mechanisms of five axes are Y-axis linear motion mechanism 31 and Z-axis linear motion mechanism 32. The other three axes among the drive mechanisms of five axes are A-axis rotation mechanism 35, B-axis rotation mechanism 36, and C-axis rotation mechanism 37.

A-axis rotation mechanism 35 is attached to Z-axis linear motion mechanism 32. A-axis rotation mechanism 35 rotates workpiece W with the A-axis extending in the X direction from Z-axis linear motion mechanism 32 as the center of rotation.

B-axis rotation mechanism 36 is attached to A-axis rotation mechanism 35 via box-shaped holding body 42 in which an upper side is opened. B-axis rotation mechanism 36 rotates workpiece W with the B-axis extending in the Y direction from A-axis rotation mechanism 35 as the center of rotation. Holding body 42 is formed in a box shape with an open upper portion, and houses supporting arm 41, B-axis rotation mechanism 36, and the like inside. Therefore, workpiece drive unit 30 can be made smaller.

C-axis rotation mechanism 37 is attached to B-axis rotation mechanism 36 via supporting arm 41. Fixing jig 40 is attached to the front end side of C-axis rotation mechanism 37. C-axis rotation mechanism 37 rotates workpiece W with C-axis extending in the Z direction from supporting arm 41 as the center of rotation.

According to the configuration of Exemplary Embodiment 8, the number of drive mechanisms of workpiece drive unit 30 can be increased. As a result, the adjustment range of the position of workpiece W can be further widened.

Exemplary Embodiment 9

Hereinafter, a schematic configuration of printing apparatus 1 of Exemplary Embodiment 9 of the present disclosure will be described based on FIG. 23.

Figure 23:
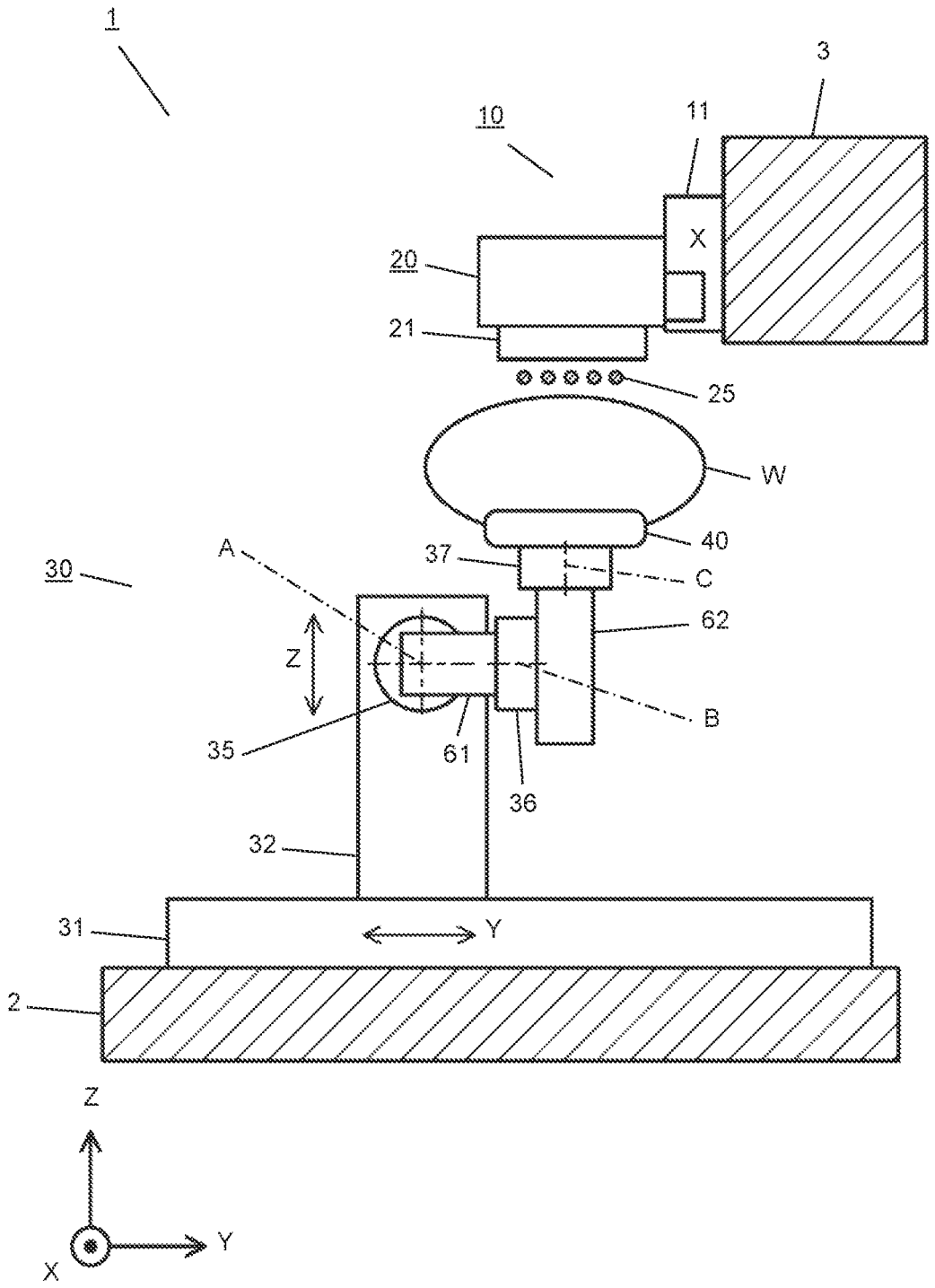
FIG. 23 is a side view illustrating a schematic configuration of a printing apparatus according to Exemplary Embodiment 9.

FIG. 23 is a side view illustrating a schematic configuration of printing apparatus 1 according to Exemplary Embodiment 9. Hereinafter, the same parts as those in Exemplary Embodiment 1 are designated by the same reference numerals, and only the differences will be described.

As illustrated in FIG. 23, printing unit 10 of printing apparatus 1 of Exemplary Embodiment 9 includes X-axis linear motion mechanism 11 and a plurality of ink jet parts 20.

Workpiece drive unit 30 includes drive mechanisms of five axes. Two axes among the drive mechanisms of five axes are Y-axis linear motion mechanism 31 and Z-axis linear motion mechanism 32. The other three axes among the drive mechanisms of five axes are A-axis rotation mechanism 35, B-axis rotation mechanism 36, and C-axis rotation mechanism 37.

A-axis rotation mechanism 35 is attached to Z-axis linear motion mechanism 32. A-axis rotation mechanism 35 rotates workpiece W with the A-axis extending in the X direction from Z-axis linear motion mechanism 32 as the center of rotation.

B-axis rotation mechanism 36 is attached to A-axis rotation mechanism 35 via first arm 61. B-axis rotation mechanism 36 rotates workpiece W with the B-axis extending in the Y direction from first arm 61 as the center of rotation.

C-axis rotation mechanism 37 is attached to B-axis rotation mechanism 36 via second arm 62. Fixing jig 40 is attached to C-axis rotation mechanism 37. C-axis rotation mechanism 37 rotates workpiece W with C-axis extending in the Z direction from second arm 62 as the center of rotation.

According to the configuration of Exemplary Embodiment 9, the number of drive mechanisms of workpiece drive unit 30 can be increased. As a result, the adjustment range of the position of workpiece W can be further widened.

Exemplary Embodiment 10

Hereinafter, a schematic configuration of printing apparatus 1 of Exemplary Embodiment 10 of the present disclosure will be described based on FIG. 24.

Figure 24:
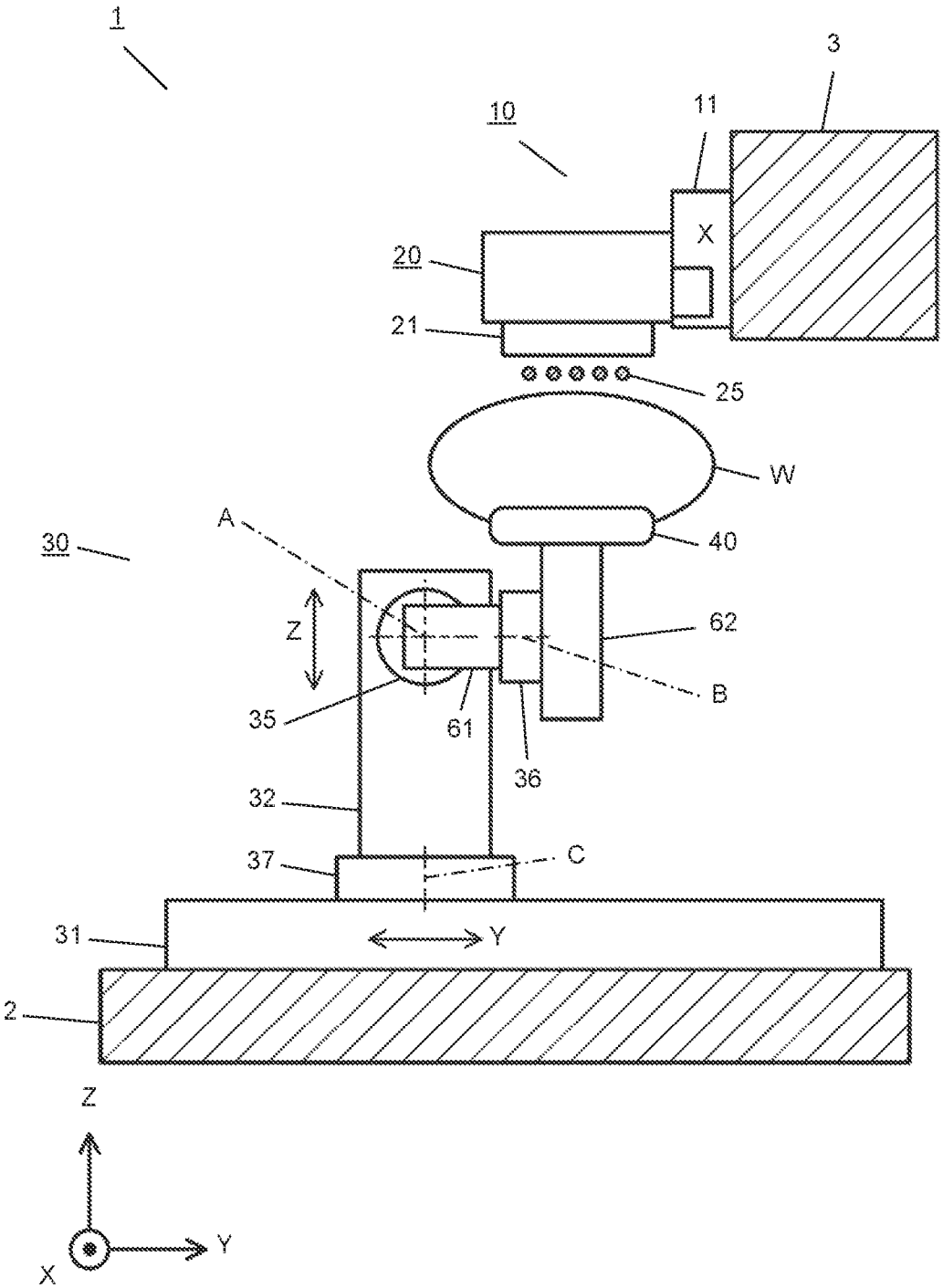
FIG. 24 is a side view illustrating a schematic configuration of a printing apparatus according to Exemplary Embodiment 10.

FIG. 24 is a side view illustrating a schematic configuration of printing apparatus 1 according to Exemplary Embodiment 10. Hereinafter, the same parts as those in Exemplary Embodiment 1 are designated by the same reference numerals, and only the differences will be described.

As illustrated in FIG. 24, printing unit 10 of printing apparatus 1 of Exemplary Embodiment 10 includes X-axis linear motion mechanism 11 and a plurality of ink jet parts 20.

Workpiece drive unit 30 includes drive mechanisms of five axes. Two axes among the drive mechanisms of five axes are Y-axis linear motion mechanism 31 and Z-axis linear motion mechanism 32. The other three axes among the drive mechanisms of five axes are A-axis rotation mechanism 35, B-axis rotation mechanism 36, and C-axis rotation mechanism 37.

Y-axis linear motion mechanism 31 is mounted on frame 2. Y-axis linear motion mechanism 31 moves workpiece W in the sub scanning direction.

C-axis rotation mechanism 37 is attached to Y-axis linear motion mechanism 31. C-axis rotation mechanism 37 rotates workpiece W with C-axis extending in the Z direction from Y-axis linear motion mechanism 31 as the center of rotation.

Z-axis linear motion mechanism 32 is attached to C-axis rotation mechanism 37. Z-axis linear motion mechanism 32 moves workpiece W in the vertical direction.

A-axis rotation mechanism 35 is attached to Z-axis linear motion mechanism 32. A-axis rotation mechanism 35 rotates workpiece W with the A-axis extending in the X direction from Z-axis linear motion mechanism 32 as the center of rotation.

B-axis rotation mechanism 36 is attached to A-axis rotation mechanism 35 via first arm 61. Fixing jig 40 is attached to B-axis rotation mechanism 36 via second arm 62. B-axis rotation mechanism 36 rotates workpiece W with the B-axis extending in the Y direction from first arm 61 as the center of rotation.

According to the configuration of Exemplary Embodiment 10, the number of drive mechanisms of workpiece drive unit 30 can be increased. As a result, the adjustment range of the position of workpiece W can be further widened.

What is claimed is:

1. A printing apparatus for printing a predetermined image by discharging ink onto a workpiece having a curved surface, the printing apparatus comprising:

a printing unit that discharges the ink onto a surface of the workpiece; and a workpiece drive unit that adjusts a position of the workpiece, wherein the printing unit includes a plurality of ink jet parts that discharge the ink, a main scanning linear motion mechanism that moves each of the plurality of ink jet parts in the same main scanning direction; and wherein the main scanning linear motion mechanism of the printing unit:

moves an ink jet part involved in printing the workpiece among the plurality of ink jet parts so as to face the surface of the workpiece, and moves the one or more remaining ink jet parts on the main scanning linear motion mechanism among the plurality of ink jet parts to retreat from the surface of the workpiece.

2. The printing apparatus of claim 1, wherein one of the ink jet parts discharges the ink with a plurality of colors.

3. The printing apparatus of claim 2, wherein the plurality of colors are four colors of cyan, magenta, yellow, and black.

4. The printing apparatus of claim 1,
wherein the ink jet part includes a curing part that cures the ink.

5. The printing apparatus of claim 1,
wherein the ink jet part includes a part for applying ink for a base or a part for applying ink to an upper portion.

6. The printing apparatus of claim 1,
wherein the ink jet part includes
a plurality of curing parts that cures the ink and
a head part that discharges the ink, and
the curing parts are disposed on both sides of the head part.

7. The printing apparatus of claim 1,
wherein the ink jet part includes a distance measurement part.

8. The printing apparatus of claim 1,
wherein the plurality of ink jet parts are moved on the main scanning linear motion mechanism.

9. The printing apparatus of claim 1,
wherein the printing unit includes a sub scanning linear motion mechanism that moves at least one of the plurality of ink jet parts in a sub scanning direction intersecting with the main scanning direction.

10. The printing apparatus of claim 1,
wherein the printing unit includes a forward and backward linear motion mechanism that moves at least one of the plurality of ink jet parts forward and backward with respect to the workpiece.

11. The printing apparatus of claim 1,
wherein the printing unit includes a rotation mechanism that rotates at least one of the plurality of ink jet parts.

12. The printing apparatus of claim 1,
wherein the workpiece drive unit includes drive mechanisms of at least four axes, and
at least two axes of the drive mechanisms of four axes are configured by a rotation mechanism.

13. The printing apparatus of claim 1,
wherein the main scanning linear motion mechanism includes a first main scanning linear motion mechanism and a second main scanning linear motion mechanism arranged in parallel to each other.

14. The printing apparatus of claim 13,
wherein the first main scanning linear motion mechanism includes a first supporting member that holds a head part of the ink jet part, and
the first supporting member includes a horizontal part extending along the first main scanning linear motion mechanism in a horizontal direction and a vertical part extending downward from an end portion of the horizontal part.

15. A printing apparatus for printing a predetermined image by discharging ink onto a workpiece having a curved surface, the printing apparatus comprising:
a printing unit that discharges the ink onto a surface of the workpiece; and
a workpiece drive unit that adjusts a position of the workpiece,
wherein the printing unit includes
a plurality of ink jet parts that discharge the ink,
a main scanning linear motion mechanism that moves each of the plurality of ink jet parts in the same main scanning direction;
wherein the main scanning linear motion mechanism includes a first main scanning linear motion mechanism and a second main scanning linear motion mechanism arranged in parallel to each other; and
wherein the plurality of ink jet parts are arranged in a row along the main scanning direction and are alternately attached to the first main scanning linear motion mechanism and the second main scanning linear motion mechanism.

16. A printing apparatus for printing a predetermined image by discharging ink onto a workpiece having a curved surface, the printing apparatus comprising:
a printing unit that discharges the ink onto a surface of the workpiece; and
a workpiece drive unit that adjusts a position of the workpiece,
wherein the printing unit includes
a plurality of ink jet parts that discharge the ink,
a main scanning linear motion mechanism that moves each of the plurality of ink jet parts in the same main scanning direction;
wherein the main scanning linear motion mechanism includes a first main scanning linear motion mechanism and a second main scanning linear motion mechanism arranged in parallel to each other; and
wherein the first main scanning linear motion mechanism and the second main scanning linear motion mechanism are arranged in a vertical direction.

* * * * *